US012416235B2

(12) United States Patent
Heller

(10) Patent No.: US 12,416,235 B2
(45) Date of Patent: Sep. 16, 2025

(54) STACKED DYNAMIC STEADY-STATE FLOW AND CHEMISTRY PROFILING FOR LONG-SCREENED TEST WELLS USED IN MUD ROTARY PILOT HOLES

(71) Applicant: BESST, Inc., San Rafael, CA (US)

(72) Inventor: Noah R. Heller, Fairfax, CA (US)

(73) Assignee: BESST, Inc., San Rafael, CA (US)

( * ) Notice: Subject to any disclaimer, the term of this patent is extended or adjusted under 35 U.S.C. 154(b) by 492 days.

(21) Appl. No.: 17/875,178

(22) Filed: Jul. 27, 2022

(65) Prior Publication Data

US 2023/0109552 A1 Apr. 6, 2023

Related U.S. Application Data

(60) Provisional application No. 63/247,042, filed on Sep. 22, 2021.

(51) Int. Cl.
*E21B 49/00* (2006.01)
*E21B 49/08* (2006.01)

(52) U.S. Cl.
CPC ..... *E21B 49/008* (2013.01); *E21B 49/088* (2013.01)

(58) Field of Classification Search
CPC ..... E21B 49/008; E21B 49/088
See application file for complete search history.

(56) References Cited

U.S. PATENT DOCUMENTS 3,250,326 A * 5/1966 Witherspoon ..... B65G 5/00 166/263
2006/0226077 A1* 10/2006 Stark ..... F04F 5/10 210/257.2

(Continued)

FOREIGN PATENT DOCUMENTS

JP 2922897 B1 * 2/2000 ..... G01V 3/18
JP 2008169622 * 7/2008 ..... G01F 23/14

*Primary Examiner* — Lisa M Caputo
*Assistant Examiner* — Sharah Zaab
(74) *Attorney, Agent, or Firm* — ROEDER & BRODER LLP; James P. Broder

(57) ABSTRACT

A method and system for determining dynamic steady-state flow and chemistry of groundwater within a long-screened test well, includes (i) drilling a pilot hole through an aquifer; (ii) installing a test well within the pilot hole, including a well screen that is at least 40 feet in length; (iii) positioning a pump within the test well to move the groundwater within the test well; (iv) positioning a packer assembly within the test well to selectively provide a seal between the test well and the pilot hole; and (v) performing downhole testing at a plurality of different depths within the test well with miniaturized technologies that are equal to or less than 1.5 inches in diameter to determine a dynamic steady-state flow and chemistry profile of the groundwater within the test well. The pump is used at a first depth and then is moved to a second depth within the test well to perform stacked dynamic steady-state flow and chemistry profiles. The miniaturized technologies include a tracer injection system that determines downhole velocity and flow measurements of the groundwater within the test well, and a groundwater sampling system that selectively removes groundwater samples from the test well.

26 Claims, 12 Drawing Sheets

(56) References Cited

U.S. PATENT DOCUMENTS

| | | | | |
|---|---|---|---|---|
| 2007/0007005 | A1* | 1/2007 | Heller | E21B 49/081 166/264 |
| 2007/0062273 | A1* | 3/2007 | Kalfayan | G09B 7/02 73/152.18 |
| 2013/0333881 | A1* | 12/2013 | Heller | E03B 3/08 166/250.15 |
| 2017/0254687 | A1* | 9/2017 | Heller | E21B 47/11 |

* cited by examiner

STACKED DYNAMIC STEADY-STATE FLOW AND CHEMISTRY PROFILING FOR LONG-SCREENED TEST WELLS USED IN MUD ROTARY PILOT HOLES

RELATED APPLICATION

This application claims priority on U.S. Provisional Application Ser. No. 63/247,042 filed on Sep. 22, 2021 and entitled "STACKED DYNAMIC STEADY-STATE FLOW AND CHEMISTRY PROFILING FOR LONG-SCREENED TEST WELLS USED IN MUD ROTARY PILOT HOLES". As far as permitted, the contents of U.S. Provisional Application Ser. No. 63/247,042 are incorporated in their entirety herein by reference.

BACKGROUND

Downhole, vertical delineation of water quality in existing groundwater production and monitoring wells as well as exploratory pilot holes (also sometimes referred to as "boreholes" or "test holes") is typically financially constrained when acquiring data to locate new public supply wells. As such, wellhead sample concentrations from nearby production wells are used as a make-do approach to identify potential locations for pilot holes that are then used to locate or convert into groundwater production wells. Although use of vertical chemistry and geology is a routine practice in oil and gas exploration when adding more wells to existing oil fields, the groundwater resource market has been slow to adopt the benefits of this standard practice, thus leading to large overruns in construction costs due to failed water chemistry from new wells. Exacerbating this problem is the sparing use of "zone tests", the temporary test well procedure commonly employed within the pilot hole to delineate vertical distribution of groundwater availability and quality at the location selected or within proximity of the new production well.

The absence of vertical chemistry data from vicinity wells and the spartan approach to vertical testing in the pilot hole sets up a series of cascading data deficiencies where poor water quality at lithologic boundaries exposes the well owner and consultant to risk of cost overruns due to follow-on treatment and blending. Now, there is a real possibility that poor water quality from one or more clay bed boundaries is combined with good water quality from the central portion of permeable zones, thus blending aquifer chemistry to exceed the maximum concentration limits set by government agencies.

FIG. 1 is a simplified schematic illustration of a prior art groundwater profiling system 10P usable to delineate vertical distribution of groundwater availability and quality at a location selected or within proximity of a new production well. The prior art groundwater profiling system 10P is configured to determine groundwater availability and quality by evaluating a plurality of zone test intervals within a given well.

More particularly, as shown in FIG. 1, within the prior art groundwater profiling system 10P, a pilot hole 12P was drilled through one or more aquifers 14P within a subsurface region 16P (below surface 18P) including one or more good, permeable zones 20P (three are shown in FIG. 1), as well as one or more clay boundaries 22P (two are shown in FIG. 1) that separate the permeable zones 20P. Additionally, as shown, a prior art test well 24P was installed within the pilot hole 12P, the prior art test well 24P including a support casing 26P and a well screen 28P. The prior art groundwater profiling system 10P further includes a pump 30P that is movably positionable within the prior art test well 24P. Groundwater 32P is illustrated as a means to define the good, permeable zones 20P.

As shown, the pilot hole 12P was drilled for purposes of installing the prior art test well 20P. The pilot hole 12P can be drilled and/or formed in any suitable manner. For example, in the southwestern US, Texas and other states, conventional zone tests are performed in both direct mud rotary and reverse mud rotary pilot holes. Direct mud rotary pilot holes are typically smaller in diameter than reverse mud rotary pilot holes and are typically approximately 12-inches to 14-inches in diameter. Within these holes, 6-inch to 8-inch diameter test wells, respectively, are constructed with varying lengths of well screen, depending on the application. Direct mud rotary wells are either converted into some type of production well, an environmental monitoring well or abandoned. Reverse mud rotary pilot holes are commonly larger than direct rotary pilot holes, oftentimes 14-inches or greater in diameter and are most typically a precursor to production well construction; where the hole is reamed (drilled)-out or enlarged to a diameter in which the production well is constructed. The rationale behind this approach is that the drilling rig used for the large diameter pilot hole is the same rig used for making the hole bigger to construct the new production well, and thereby avoids the need and cost to mobilize a larger, more powerful rig for constructing the production well from a smaller diameter pilot hole. Selection of each zone test interval is based on a review of the drill-cuttings collected during advancement of the pilot hole and from the electric log suite obtained after completion of the pilot hole.

For the test well 24P, the support casing 26P can be a hollow, generally cylinder-shaped structure that extends in a generally downward direction into the subsurface region 16P to help provide access to the groundwater 32P, and/or other fluids and materials present within the subsurface region 16P. The well screen 28P extends from and/or forms a portion of the support casing 26P within the subsurface region 16P. The well screen 28P can comprise a perforated pipe that provides an access means through which the groundwater 32P enters the test well 24P. As illustrated, the well screen 28P can be adapted to be positioned at a level within the subsurface region 16P in vertical alignment with and/or substantially adjacent to the permeable zones 20P of the aquifer 14P to provide ready access to the groundwater 32P within the subsurface region 16P. Additionally, the well screen 28P is often provided in a number of individual screened sections that are configured to be positioned only in vertical alignment with and/or substantially adjacent to certain portions of the permeable zones 20P.

As shown, FIG. 1 illustrates the prior art test well 24P being utilized for a Standard Backfill Zone Test in order to delineate vertical distribution of groundwater availability and quality at a location selected or within proximity of a new production well. More specifically, FIG. 1 illustrates the prior art groundwater profiling system 10P being used to profile the groundwater 32P at three different depths within the prior art test well 24P. Stated in another manner, the prior art groundwater profiling system 10P is shown being used to evaluate groundwater availability and quality within three different zone test intervals, each zone test interval being in vertical alignment with and/or substantially adjacent to one of the permeable zones 20P. As shown, the drawing on the left shows use of a first zone test interval in vertical alignment with and/or substantially adjacent to the bottom-most permeable zone 20P; the drawing in the center shows use of a second zone test interval in vertical alignment with and/or substantially adjacent to the middle permeable zone 20P; and the drawing on the right shows use of a third zone test interval in vertical alignment with and/or substantially adjacent to the upper-most permeable zone 20P.

In application within either type of pilot hole 12P, each conventional zone test is typically constructed with a temporary well screen 28P that is 10 to 40 feet in length and composed of slotted steel or PVC which is sometimes referred to as a "stove pipe" or "temp well". A gravel pack envelope 34P is installed around the outside of the test well 24P and a thin bentonite seal 36P is emplaced on top of the gravel pack 34P. The test well 24P is then developed with the pump 30P, e.g., an electric submersible pump, until a low nephelometric unit (NTU) value is reached, which is a quantification of the clarity of the groundwater 32P and an indication when most of the drilling fluid has been removed from the zone test interval being tested. Once the test has been completed, the test well 24P is then removed from the pilot hole 12P and the tested interval backfilled with bentonite, ascending the pilot hole 12P to the next zone test interval. Thus, this process is sometimes referenced as the "Backfill Zone Test" procedure.

The repetitive construction and deconstruction process downhole makes the zone test expensive, labor-intensive, and time-consuming and, as such, limits the number of water quality tests that can be performed, thus leaving large data gaps throughout the saturated length of the pilot hole. More particularly, the cost-basis for the conventional "Backfill Zone Test" procedure typically constrains the number of tests to only 2 to 6 per pilot hole over hundreds of feet of saturated section when using direct and reverse mud rotary, as well as other drilling methods. This data paucity is then complicated by the fact that the temporary well screens are typically only 10 to 40 feet long and are typically placed within the middle of the permeable zones 20P, and not near the clay boundaries 22P where water quality is commonly poor (containing metals, semimetals, radionuclides, etc.).

Thus, unless the pilot hole site is in an area where proven reserves of clean groundwater are available, there is a risk that the well will produce non-compliant groundwater that prevents the well from being used until treatment is installed. Even in areas where the water quality is thought to be good, on a recurring basis, unexpected problems do arise within relatively short distances from other well locations where the water quality is compliant.

Moreover, with existing systems such as shown in FIG. 1, the prior art groundwater profiling system 10P often provides results that are not truly reflective of the actual conditions of the groundwater 32P within the test well 24P. For example, seemingly promising results from the "coarsified" sampling approach, where the focus is on the central areas of the permeable zones 20P, may unknowingly provide erroneous confidence that the well will be compliant. Stated in another manner, due to the testing only occurring at or near the middle of intervals of good, clean water, such as within the permeable zones 20P, the zone test results may show contaminant concentration levels, such as for arsenic, that are below levels of concern, but which may miss one or more non-compliant zones that may exist within the test well 24P. Once receiving such seemingly promising results, a production well is then constructed with screened intervals that intersect the clay beds above and below the permeable zones and sometimes run through the aquitard itself to save money on construction costs. When the new production well is turned-on, the blended concentrations can cause the production well to fail. The essential question to ask now, from a pragmatic standpoint, is if two to six downhole zone-test samples, from the central areas of permeable zones are sufficient to reliably canvass enough vertical distribution to be confident that the final well will be chemically compliant? Based on experience with profiling many hundreds of new wells the answer is "no" since three to four out of every ten new wells appear to fail based on water quality regulations shortly after startup. These wells are then deemed "stranded assets" until the water chemistry issues can be resolved. The new problem initiates a time sink and funding allocation dilemma that leads to overruns of the intended budget since treatment, blending or well modification to block out poor water quality is required to fix the problem.

In summary, the reasons for water quality failure of new wells are varied, but generally, the problems often stem from a lack of subsurface data combined with geologic heterogeneities that are not accounted for near lithologic boundaries that are shared with clay beds. It is at these boundaries where supply wells commonly draw upon poorer water quality from nearby clay zones that contain elevated concentrations of metals, semimetals, radionuclides and other constituents that are blended with better water quality from more central areas of the screen; often resulting in a composite blend concentration at the wellhead that exceeds regulatory limits. When it comes to anthropogenic contaminants, numerous studies have shown that these chemical compounds can "pool" or concentrate on top of clay boundaries as well as be adsorbed onto organic matter embedded within the clay matrix itself; the "electrochemical stickiness" of which can be expressed as a retardation coefficient. When permeable sediments in direct contact with these boundaries are pumped-on, contaminants can be released from these clay beds by different processes including oxidation and change in redox potential, change in pH, desorption, and advective-stripping. Moreover, there is increasing evidence that microbial activity plays a role in the release of certain metals, semi-metals and other compounds at the clay boundaries as well.

Accordingly, it is desired to develop a system and method to inhibit such issues from adversely impacting the ability to locate and develop new public supply wells.

SUMMARY

The present invention is directed toward a method for determining dynamic steady-state flow and chemistry of groundwater within a long-screened test well, the method including the steps of (i) drilling a pilot hole through one or more aquifers; (ii) installing a test well within the pilot hole, the test well including a well screen that is at least 40 feet in length; (iii) positioning a pump within the test well, the pump being configured to move the groundwater within the test well; (iv) positioning a packer assembly within the test well, the packer assembly being configured to selectively provide a seal between the test well and the pilot hole; and (v) performing downhole testing at a plurality of different depths within the test well with miniaturized technologies that are equal to or less than 1.5 inches in diameter, the downhole testing being utilized to determine a dynamic steady-state flow and chemistry profile of the groundwater within the test well.

In some embodiments, the pump is an electric submersible pump.

In certain embodiments, the pump and the packer assembly are conjoined together, with the packer assembly including an inflatable packer that is attached to the pump near a bottom of the pump.

In various embodiments, the pump is used at a first depth within the test well and then is moved from the first depth to a second depth within the test well that is different than the first depth to perform stacked dynamic steady-state flow and chemistry profiles.

In some embodiments, the step of drilling includes evaluating cuttings and core removed during drilling of the pilot hole for at least one of type of rock, type of sediment and water bearing properties.

In certain embodiments, drill cuttings and electric logs are used to locate screened intervals of the well screen and to develop a tracer injection and sampling plan to be implemented with the miniaturized technologies.

In alternative embodiments, the step of drilling includes drilling the pilot hole using one of (i) a direct mud rotary drilling method that is configured to drill the pilot hole having a diameter of between approximately 12 inches and 14 inches; and (ii) a reverse mud rotary drilling method that is configured to drill the pilot hole having a diameter of at least approximately 14 inches.

In many embodiments, the miniaturized technologies include a tracer injection system that is configured to determine downhole velocity and flow measurements of the groundwater within the test well.

In some embodiments, the tracer injection system includes a flexible tube that is filled with a tracer material, the flexible tube being configured to inject the tracer material sideways into the groundwater within the test well to determine the downhole velocity and flow measurements. Air bubbles are inhibited from entering the flexible tube. Timing of injection of the tracer material from the flexible tube into the groundwater within the test well can be controlled at least in part by a timer control unit.

In certain embodiments, the miniaturized technologies further include a groundwater sampling system that is configured to selectively remove groundwater samples from the test well.

In some embodiments, the tracer injection system and the groundwater sampling system are joined into a single, conjoined, downhole unit so that the tracer injection system and the groundwater sampling system move together to different depths within the test well.

In various embodiments, the miniaturized technologies include a groundwater sampling system that is configured to selectively remove groundwater samples from the test well.

In certain embodiments, the groundwater sampling system includes a miniaturized pump, a section of jacketed tubing, and a volume booster. The section of jacketed tubing can include a first tube that is configured to deliver compressed gas from a surface level to a targeted sampling depth, and a second tube that is configured to transfer groundwater from the targeted sampling depth to the surface level.

In some applications, the present invention is further directed toward a flow and chemistry profiling system for determining dynamic steady-state flow and chemistry of groundwater within a long-screened test well, the flow and chemistry profiling system including (i) a pilot hole that is drilled through one or more aquifers; (ii) a test well that is installed within the pilot hole, the test well including a well screen that is at least 40 feet in length; (iii) a pump that is positioned within the test well, the pump being configured to move the groundwater within the test well; (iv) a packer assembly that is positioned within the test well, the packer assembly being configured to selectively provide a seal between the test well and the pilot hole; and (v) miniaturized technologies that are utilized for performing downhole testing at a plurality of different depths within the test well, the miniaturized technologies being equal to or less than 1.5 inches in diameter, the downhole testing being utilized to determine a dynamic steady-state flow and chemistry profile of the groundwater within the test well.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
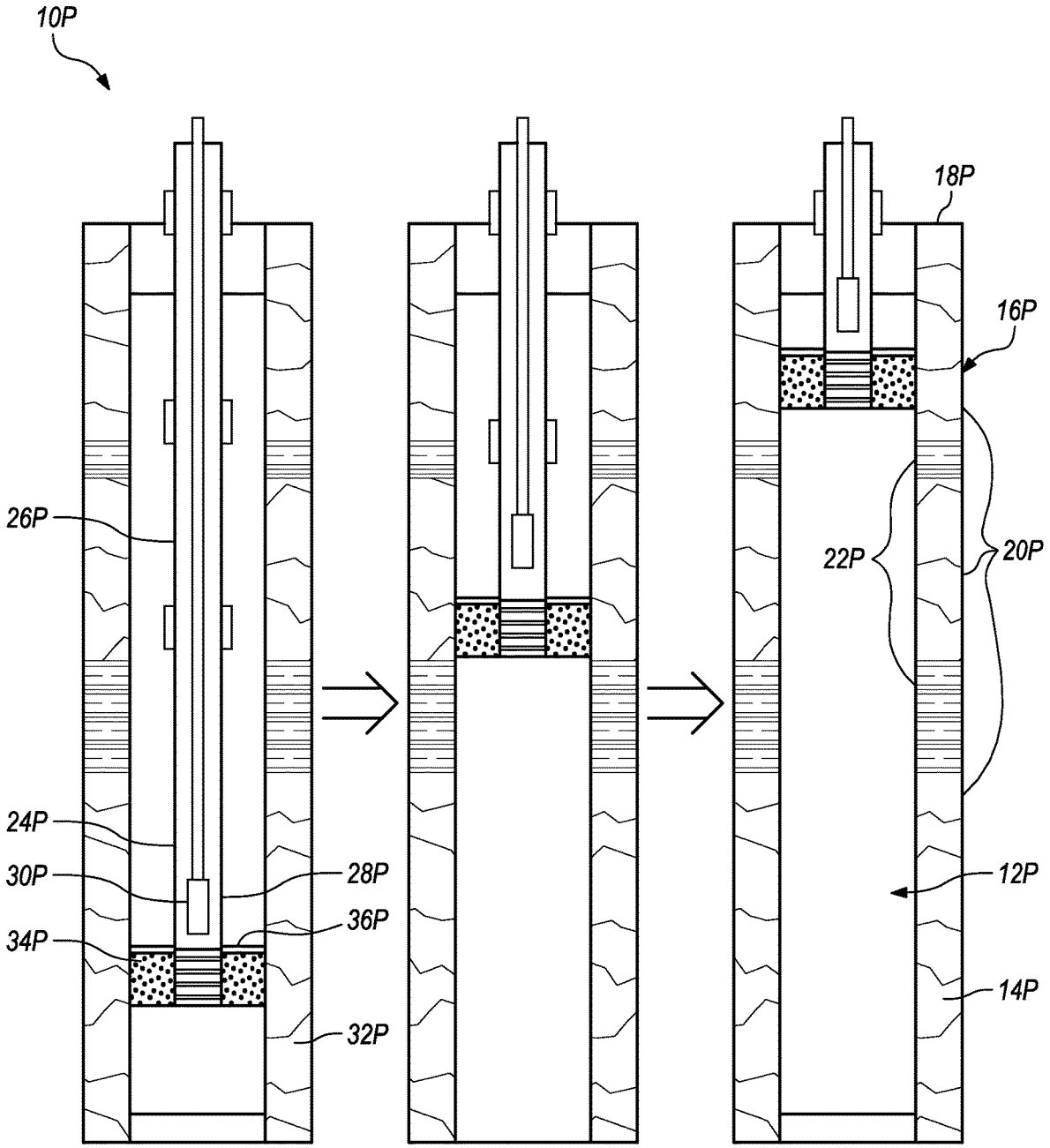
FIG. 1 (Prior Art)
FIG. 1 is a simplified schematic illustration of a prior art groundwater profiling system usable to delineate vertical distribution of groundwater availability and quality at a location selected or within proximity of a new production well.

Embodiments of the present invention are described herein in the context of a system and method for overcoming and/or minimizing potential issues impacting the ability to locate and develop new public supply wells by using a new vertical exploration method and technological advancement called "Stacked Dynamic Flow and Chemistry Profiling (SDP) in Long Screened Test Wells". Accomplished with miniaturized profiling technologies, the entire profiling system costs from slightly less to modestly more than conventional zone testing. SDP multiplies vertical delineation of water chemistry downhole by four to eight times and can be performed in significantly less time than traditional zone tests. SDP can also provide a more technically robust and conservative approach to identifying water quality risks prior to well construction.

The SDP approach is particularly useful when weighing the cost of treatment and/or blending system construction as well as long-term operation and maintenance if the new well should happen to fail because it did not meet water quality regulations. When this problem arises, the true cost of the well is the total cost of the well plus the treatment(s) or blending system(s) required to bring its water supply online. A failed well can be a tough economic and political pill to swallow since utilities and rate payers alike end up shouldering the increasing costs over time that are needed to build and operate these facilities. Moreover, some of the treatment technologies are complex and difficult to operate. Finding qualified operators and being able to sustainably cover their labor costs year over year is potentially a challenge unto itself. High resolution, rapid pilot hole characterization using SDP can limit both short-term and long-term risks from the ever-present potential of new well water quality problems.

Even though the process might be equal to or even a little bit more expensive than traditional zone testing, it can function as a robust insurance policy to reduce risk from the stated consequences. The long-screened test well provides the opportunity to rapidly test many more locations that are potentially geochemically problematic rather than an exclusive focus on the mid-section of the permeable zones based on affordability and where the water quality is often the best. This data can then be used to better inform the construction process of the well screens in terms of their vertical length and how much buffer distance should be allocated between the well screen and adjoining clay beds.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming but would nevertheless be a routine undertaking of engineering for those of ordinary skill in the art having the benefit of this disclosure.

The description of the invention below provides the basic set up, detailed operating components and procedures, and flow and mass balance calculations for using stacked dynamic profiling (SDP) in temporary long-screened test wells in lieu of traditional, temporary short-screened zone tests.

Figure 2:
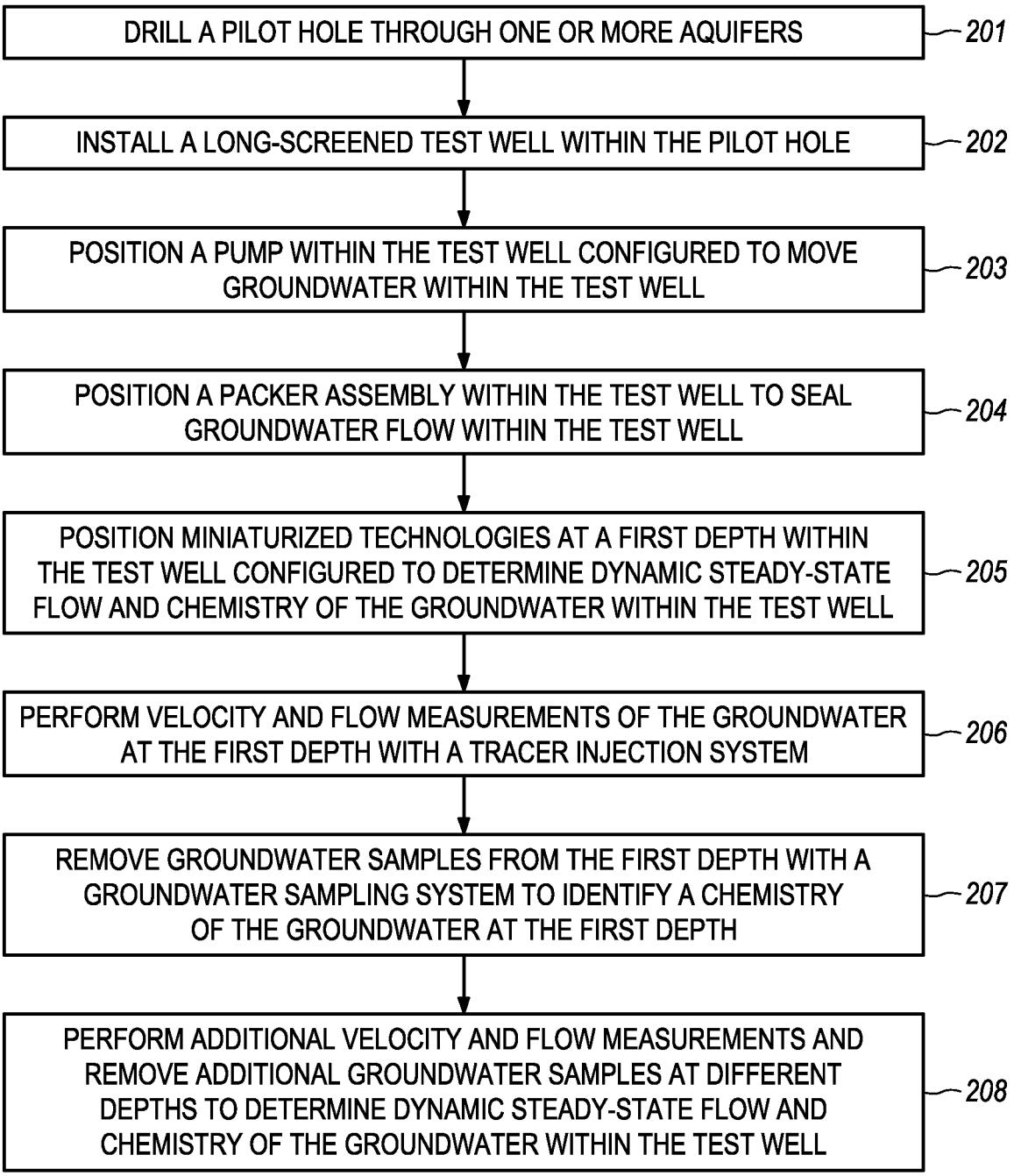
FIG. 2 is a simplified flowchart illustrating general operational procedures of an embodiment of a groundwater flow and chemistry (stacked dynamic) profiling system and method for determining dynamic steady-state flow and chemistry of groundwater within a long-screened test well.

FIG. 2 is a simplified flowchart illustrating general operational procedures of a system and method for determining dynamic steady-state flow and chemistry of groundwater within a long-screened test well. It is appreciated that, in certain applications, the steps delineated herein can be modified, reordered, combined, or omitted, and additional steps can be added without deviating from the intended breadth and scope of the present invention.

At step 201, a pilot hole is drilled through one or more aquifers. In various embodiments, the pilot hole (also sometimes referred to as a "test hole" or "borehole") is drilled through the one or more aquifers for the purpose of building a test well and subsequently a groundwater supply well. In certain non-exclusive implementations, the aquifers can be located in sedimentary basins and in fractured bedrock, and can be of any depth.

At step 202, a test well is installed within the pilot hole.

Figure 3A:
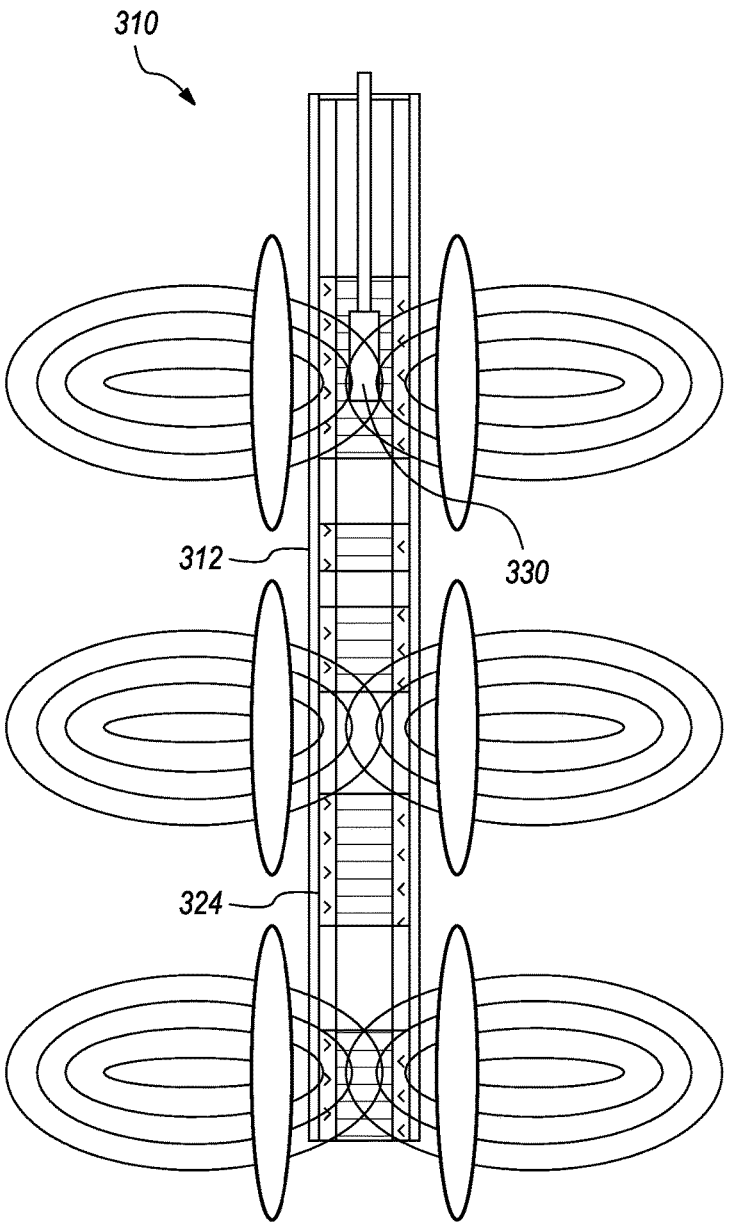
FIG. 3A is a simplified schematic illustration showing use of a pump to develop the test well within a pilot hole as part of the groundwater flow and chemistry profiling system by drilling fluid leaked into the surrounding formation during the drilling process.
Figure 3B:
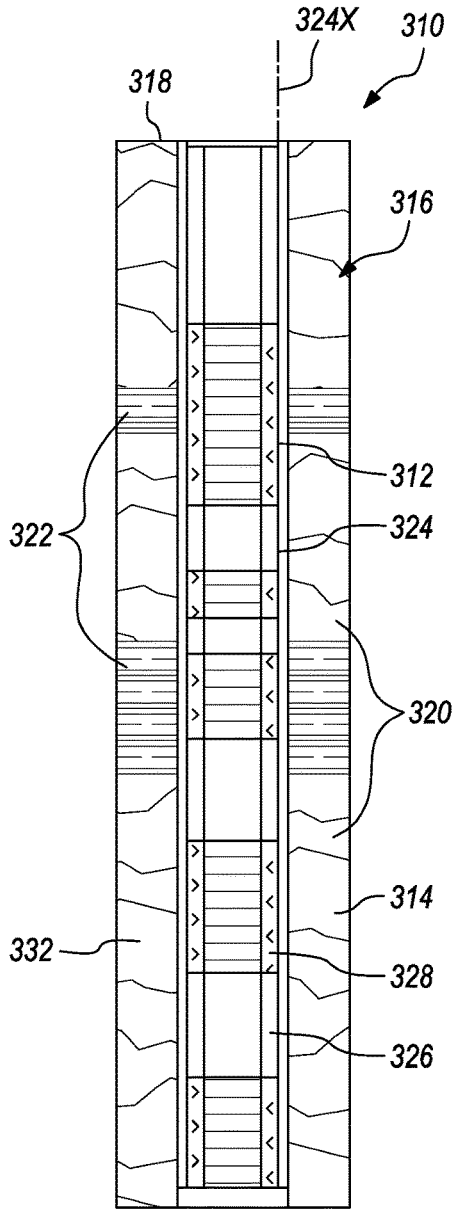
FIG. 3B is a simplified schematic illustration showing construction of the long-screened test well.

Referring now to FIG. 3A, FIG. 3A is a simplified schematic illustration showing use of a pump 330 to develop a test well 324 within a pilot hole 312 as part of a groundwater flow and chemistry profiling system 310 (also sometimes referred to herein as a "groundwater profiling system" or simply a "profiling system") by drilling fluid leaked into the surrounding formation during the drilling process. Additionally, FIG. 3B is a simplified schematic illustration showing construction of the long-screened test well 324 within the pilot hole 312 for the groundwater profiling system 310.

As shown, the pilot hole 312 has been drilled into one or more aquifers 314 within a subsurface region 316 (below surface 318) including one or more good, permeable zones 320, as well as one or more clay boundaries 322 that separate the permeable zones 320.

The pilot hole 312 can be drilled and/or formed in any suitable manner. For example, the pilot hole 312 can be drilled with any method, including mud and air rotary, reverse rotary, sonic, dual-tube percussion, dual-tube rotary, air rotary casing hammer, cable tool, auger, direct push, or any other suitable method. The pilot hole 312 can also be of any diameter, the purpose of which is to build a long-screened test well 324 in advance of the groundwater supply well for the purpose of profiling for zonal flow and chemistry. In one non-exclusive implementation, the pilot hole 312 can be a small diameter pilot hole, such as between approximately 12 inches and 14 inches in diameter, that can be drilled using a direct mud rotary drilling method. In another non-exclusive implementation, the pilot hole 312 can be a large diameter pilot hole, such as larger than approximately 14 inches or larger than approximately 17.5 inches in diameter, that can be drilled using a reverse mud rotary drilling method.

In some cases, within bedrock or other hard rock environments, where the rock materials are competent, and will not collapse into the pilot hole 312, the bedrock itself can comprise the test well, without having to construct a separate test well to support the pilot hole 312 to inhibit it from collapsing.

As the pilot hole 312 is being drilled to total depth, the cuttings and core removed from the pilot hole 312 are evaluated and catalogued to evaluate the sediment or rock types and their water bearing properties including grain size distribution and type, as well as rock types and fracture bearing qualities. After the total depth of the pilot hole 312 is reached, an optional step is to run downhole geophysical equipment such as resistivity, spontaneous potential, gamma ray, neutron, density, induction or any other type of probe or sensor to generate data that can be used to infer the sediment type, rock type and basic formational parameters such as permeability, porosity, saturation, salinity, conductivity and others. In bedrock pilot holes, even downhole video cameras can be used to identify the depth and characteristics of rock fractures and lineaments that intersect the pilot hole.

In cases where the pilot hole 312 could collapse, the collective data is then used to design the test well 324, which can be made from any number of materials including any type of steel, PVC, carbon fiber, fiberglass and so on. The decision on which material to use for construction of the test well 324 depends at least in part on the depth of the pilot hole 312. For smaller diameter pilot holes 312, such as in the 12-inch to 14-inch range, the preferred diameter of the test well 324 is 6 inches to 8 inches, respectively, to achieve pumping rates ranging between 100 to 300 GPM. Larger diameter pilot holes 312 allow for larger diameter test wells 324 where higher pumping rates can be achieved.

As illustrated, the test well 324 can include a support casing 326 and a well screen 328. For the test well 324, the support casing 326 can be a hollow, generally cylinder-shaped structure that extends in a generally downward direction into the subsurface region 316 to help provide access to groundwater 332, and/or other fluids and materials present within the subsurface region 316. The well screen 328 extends from and/or forms a portion of the support casing 326 within the subsurface region 316. The well screen 328 can comprise a perforated pipe that provides an access means through which the groundwater 332 enters the test well 324. In certain embodiments, the test well 324 can have more than 40 feet of well screen 328, and quite often can have 50 to many hundreds of feet of well screen 328, either continuous or in sections, and being of any suitable diameter.

In alternative embodiments, the test well 324 is typically constructed with either a continuous gravel pack envelope 634 (as illustrated more clearly, for example, in FIG. 6B) around the outside of the test well 324 and located between the test well 324 and the formation wall of the pilot hole 312, or installed in layers where it alternates with seals 636 (as illustrated more clearly, for example, in FIG. 6B), such as bentonite seals and/or cement seals, that are aligned with fine-grained units such as clays and silts or even fine-grained rock types lacking fractures through which groundwater 332 can flow. In some embodiments, the gravel pack 634 is installed in sections of varying lengths with the seals 636 in between, the purpose of the seals 636 being to inhibit vertical migration of naturally occurring or anthropogenic contaminants through the gravel pack 634 from one or more water bearing units to one or more receiving water bearing units, before, during or after testing.

The test well 324 may also have a sanitary seal (not shown) between the top (or shallowest depth) of the gravel pack 634 and the ground surface 318, such seal being installed to inhibit migration of contaminants from the ground surface 318 vertically downward along the outside of the test well 324. Such seal can be composed of any type of cement or bentonite mixture.

Following completion of initial test well 324 construction, the test well 324 is developed, meaning that the drill flour, drilling fluid and mud cake, drilling fluid dispersants and other residual materials that have adhered to the pilot hole wall and/or have invaded into the surrounding formation are removed from the pilot hole 312 using various methods including a swab, surge block, pump, and air lifting, as well as other methods, until the groundwater 332 is satisfactorily clear for testing and sampling. Such a process is illustrated in FIG. 3A via series of concentric ovals.

In either case, the pump 330 can be an electric submersible pump that is usable in the development and as part of the groundwater sampling process that follows.

It is recognized that the support casing 326 or well screen 328 may not be precisely vertical at all locations throughout the test well 324. In fact, the support casing 326 or well screen 328 may be off-vertical by several degrees (or more) at certain locations along the depth of the test well 324. However, it is the intent of the groundwater profiling system 310 that certain components be utilized substantially perpendicularly to a longitudinal axis 324X of the support casing 326 and/or well screen 328 of the test well 324.

Returning to FIG. 2, at step 203, a pump is positioned within the test well, the pump being configured to move groundwater within the test well.

At step 204, a packer assembly (sometimes simply referred to as a "packer") is positioned within the test well, the packer assembly being configured to selectively provide a seal to inhibit groundwater flow within the test well.

Figure 4:
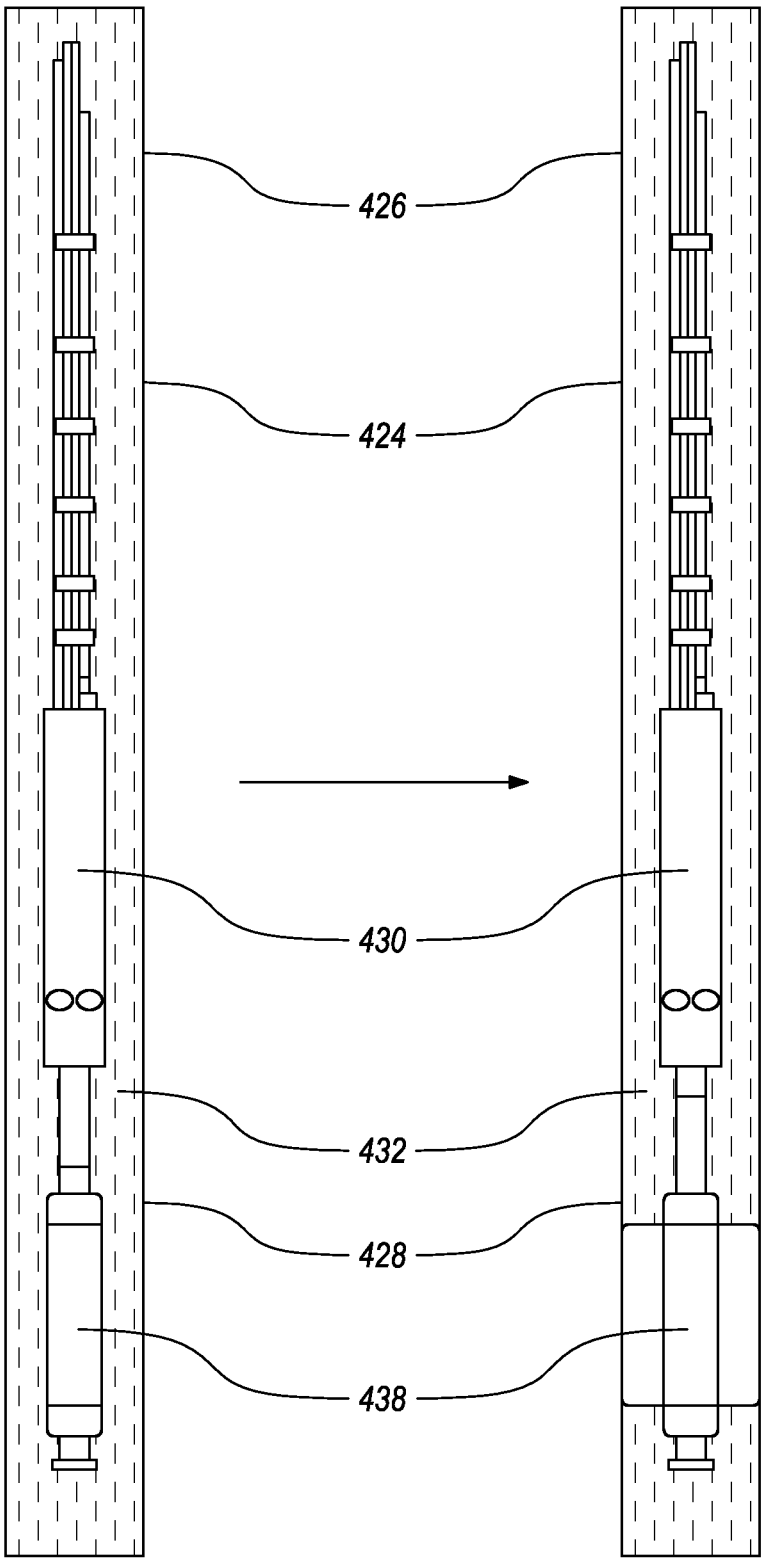
FIG. 4 is a simplified schematic illustration of an example packer specification for long-screened test wells usable as part of the groundwater flow and chemistry profiling system.

Referring now to FIG. 4, FIG. 4 is a simplified schematic illustration of an example packer specification for long-screened test wells usable as part of the flow and chemistry profiling system. In particular, FIG. 4 illustrates a pump 430 and a packer 438 being positioned together at or near a bottom of the test well 424. As shown, during use of the packer 438, the packer 438 can be selectively moved between a first (reduced) configuration, shown on the left side in FIG. 4, where the packer 438 does not engage the support casing 426 and/or the well screen 428 of the test well 424, and a second (expanded) configuration, shown on the right side in FIG. 4, where the packer 438 does engage the support casing 426 and/or the well screen 428 of the test well 424.

As shown, when the packer 438 is in the second (expanded) configuration, groundwater 432 is inhibited from freely flowing within the test well 424 from above the packer 438 to below the packer 438 and/or from below the packer 438 to above the packer 438. With such design, the packer 438 is usable to control the location and/or source of the groundwater 432 that is profiled and/or sampled through use of the groundwater profiling system 410.

In one embodiment, the packer 438 and the pump 430 are conjoined together, with the packer 438 being attached to the pump 430 near a bottom of the pump 430. Alternatively, the packer 438 and the pump 430 can be separate components that are individually positioned within the test well 424.

Figure 5:
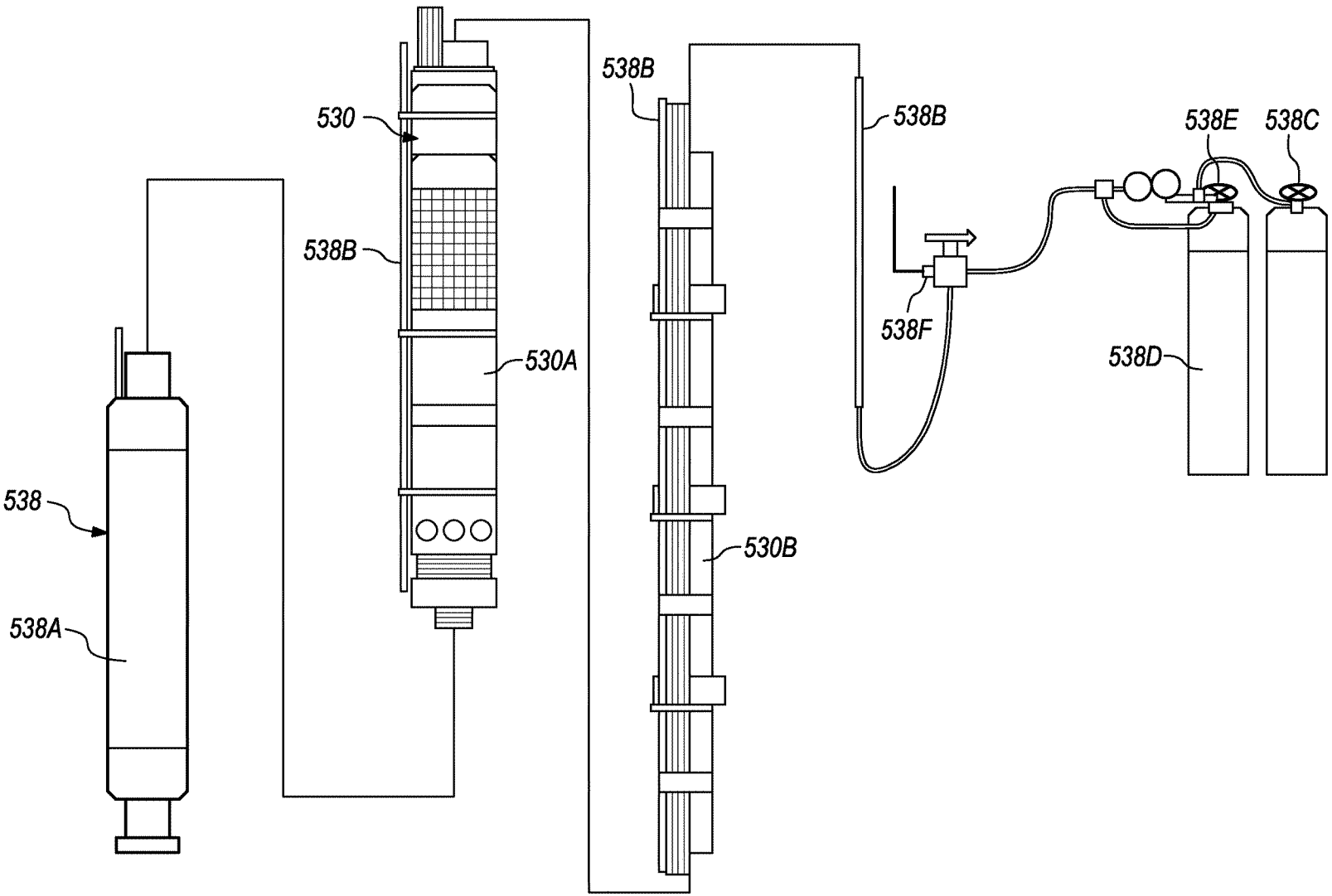
FIG. 5 is a simplified schematic illustration of a breakdown of example packer setup for the long-screened test well usable as part of the groundwater flow and chemistry profiling system.

FIG. 5 is a simplified schematic illustration of a breakdown of example packer 538 setup for the long-screened test well usable along with the pump 530 as part of the flow and chemistry profiling system. More particularly, FIG. 5 is a simplified schematic illustration of various components that can be incorporated into a representative embodiment of the packer assembly 538 and the pump 530 that can be utilized within the flow and chemistry profiling system.

As shown in FIG. 5, the packer assembly 538 can include one or more of a packer body 538A, which in some embodiments can be selectively inflatable, a packer inflation line 538B, and a packer pressurization system 538C, which can include a packer inflation fluid source 538D (also sometimes referred to as an "inflation fluid source") and an inflation fluid pressure regulator 538E (also simply referred to as a "pressure regulator"). Alternatively, the packer assembly 538 and/or the pump 530 can have different designs, and with more components or fewer components, than what is illustrated in FIG. 5.

As illustrated, the inflation fluid source 538D is configured to selectively provide an inflation fluid, such as nitrogen in one non-exclusive embodiment, in order to selectively inflate the packer body 538A and move the packer body 538A from the first (reduced) configuration to the second (expanded) configuration, such as in a manner similar to what is shown in FIG. 4. The inflation fluid can be provided via the packer inflation line 538B, which in certain embodiments can be coupled to the pump body 530A and/or the pump column 530B of the pump 530. The selective flow of the inflation fluid from the inflation fluid source 538D and through the packer inflation line 538B is further regulated through use of the pressure regulator 538E. As shown in FIG. 5, in some embodiments, the pressure regulator 538E can include a bleed-off pressure valve 538F that is selectively activated to lessen the fluid pressure within the packer inflation line 538B when it is desired to deflate the packer body 538A and move it back to the first (reduced) configuration.

The packer inflation line 538B can be coupled to the pump body 530A and/or the pump column 530B in any suitable manner. In certain non-exclusive embodiments, the packer inflation line 538B can be coupled to the pump body 530A and/or the pump column 530B with plumbers' tape, stainless-steel straps, or another securing material. Alternatively, the packer inflation line 538B can be coupled to the pump body 530A and/or the pump column 530B in another suitable manner.

The packer inflation line 538B can also be formed from any suitable materials. For example, in one embodiment, the packer inflation line 538B can be formed from a high-pressure nylon material. Alternatively, the packer inflation line 538B can be formed from any other suitable materials.

In one implementation, to perform the desired testing, the pump 530 and packer assembly 538 are first placed near the bottom of the test well 424 (illustrated in FIG. 4). In certain embodiments, the packer 538 and/or the packer body 538A is attached to the bottom of the pump 530, such as via a threaded connection assembly, and can consist of either a mechanical packer or an inflatable packer. If an inflatable packer 538 is used, then the packer inflation line 538B runs vertically alongside the outside of the pump body 530A and the pump column 530B and continues to the ground surface 318 (illustrated in FIG. 3B) where the inflation fluid source 538D, such as in the form of a compressed gas system, is located and used to inflate the packer body 538A.

In other implementations, the pump 530 and packer assembly 538 could also be placed near the top of the test well 424 or in the middle of the test well 424 to start, or in any other location other than the bottom of the test well 424. However, there are at least two reasons why the pump 530 and packer assembly 538 are typically placed near the bottom of the test well 424 as the first of one or more locations to be used during the stacked dynamic profiling. The first reason is that although miniaturized tooling, such as described in detail herein below, is being used between the pump column 530B and the well screen 428 (illustrated in FIG. 4) and support casing 426 (illustrated in FIG. 4), the small diameter tooling may not be small enough to move past the pump 530 and packer assembly 538 without getting stuck inside the test well 424. However, the miniaturized tooling is sufficiently small to move freely between the pump column 530B and the support casing 426, up and down, from one location to the next, above the pump 530 and packer assembly 538, where tracer injections and water samples can be freely collected without spatial constraints during the test.

In various embodiments, the electric submersible pump set-up used for the stacked dynamic test is similar if not the same pump 530 that is used for development, except for in various embodiments, as described, the pump 530 is configured with a conjoined inflatable packer 538 attached the to the bottom of the pump 530.

Returning to FIG. 2, at step 205, miniaturized technologies are positioned at a first depth within the test well pursuant to a tracer injection and sampling plan that has been developed in order to determine dynamic steady-state flow and chemistry of the groundwater within the test well.

Figure 6A:
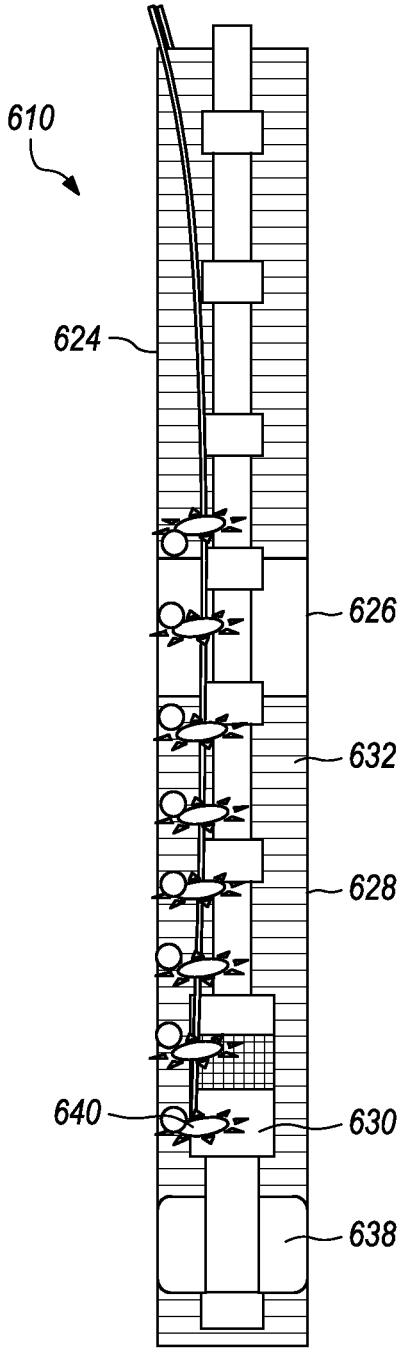
FIG. 6A is a simplified schematic illustration of an example of the groundwater flow and chemistry profiling system using temporary long-screened test wells, for use within a small diameter pilot hole.
Figure 6B:
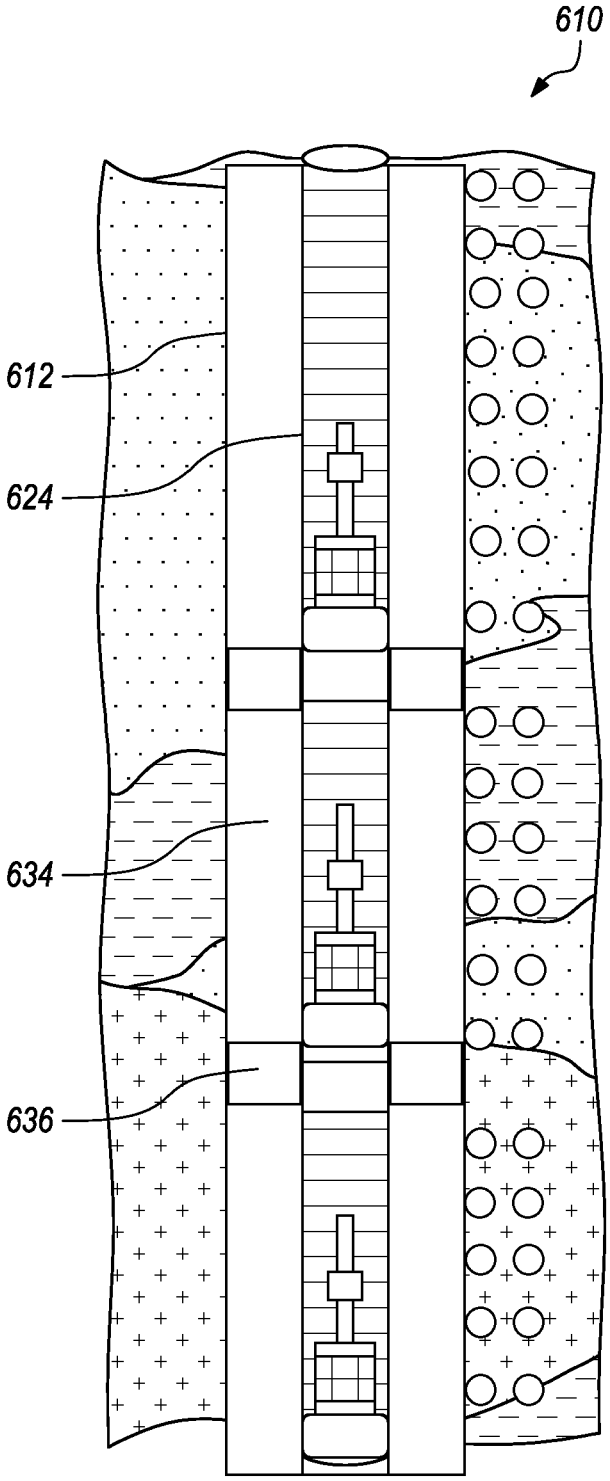
FIG. 6B is another simplified schematic illustration of the example of the groundwater flow and chemistry profiling system illustrated in FIG. 6A using temporary long-screened test wells, with a small diameter pilot hole.

Referring now to FIG. 6A, FIG. 6A is a simplified schematic illustration of an example of the groundwater flow and chemistry profiling system 610 using temporary long-screened test wells 624, for use within a small diameter pilot hole 612 (illustrated in FIG. 6B). FIG. 6A also illustrates the pump 630 and packer assembly 638 that can be positioned within the test well 624. FIG. 6A further illustrates miniaturized technologies 640 that have been positioned within the test well 624. As shown, the miniaturized technologies 640 can be positioned within the test well 624 at a depth somewhat near the positioning of the pump 630 and packer assembly 638. The miniaturized technologies 640 are configured for purposes of profiling dynamic steady-state flow of the groundwater 632 within the test well 624, as well as providing samples of the groundwater 632 from within the test well 624 so that chemistry of the groundwater 632 can be determined. In various embodiments, as described in greater detail herein below, the miniaturized technologies 640 can be moved to different depths within the test well 624 so that dynamic steady-state flow and chemistry of the groundwater 632 can be determined for various depths within the test well 624.

FIG. 6B is another simplified schematic illustration of the example of the groundwater flow and chemistry profiling system 610 illustrated in FIG. 6A using temporary long-screened test wells 624, with a small diameter pilot hole 612. FIG. 6B also illustrates that, in some embodiments, the test well 624 can be constructed with a gravel pack envelope 634 around the outside of the test well 624 and located between the test well 624 and the formation wall of the pilot hole 612, which is installed in layers where it alternates with seals 636, such as bentonite seals and/or cement seals, that are aligned with fine-grained units such as clays and silts or even fine-grained rock types lacking fractures through which groundwater 632 can flow. In some embodiments, the gravel pack 634 is installed in sections of varying lengths with the seals 636 in between, the purpose of the seals 636 being to inhibit vertical migration of naturally occurring or anthropogenic contaminants through the gravel pack 634 from one or more water bearing units to one or more receiving water bearing units, before, during or after testing.

More specifically, FIGS. 6A and 6B consists of drilling a small diameter pilot hole 612, such as measuring 12-inches to 14-inches in diameter in certain embodiments, with direct mud rotary drilling and installing a 6-inch to 8-inch diameter, long-screened test well 624, respectively. In various embodiments, long-screened test wells 624 constructed in the 12-inch to 14-inch pilot holes 612 consist of a single, continuous support casing 626, having a well screen 628 that is either continuously screened over a long interval or screened in sections, with each section potentially consisting of different lengths. This type of long-screened test well 624 can be 100 to many hundreds of feet long and is typically converted to a multi-level monitoring well or abandoned following completion of the testing. The pilot hole 612 can then be backfilled with bentonite or cement to the next shallower testing level and a new 100-foot to 120-foot long-screened well is constructed. This process continues until sufficient saturated section has been profiled for zonal flow and chemistry.

Figure 7A:
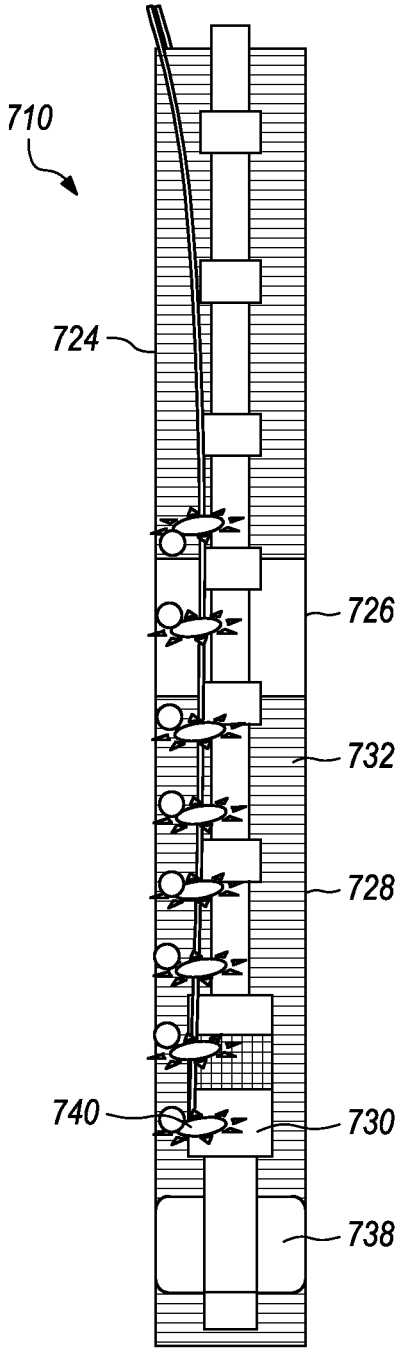
FIG. 7A is a simplified schematic illustration of another example of the groundwater flow and chemistry profiling system using temporary long-screened test wells, for use within a large diameter pilot hole.
Figure 7B:
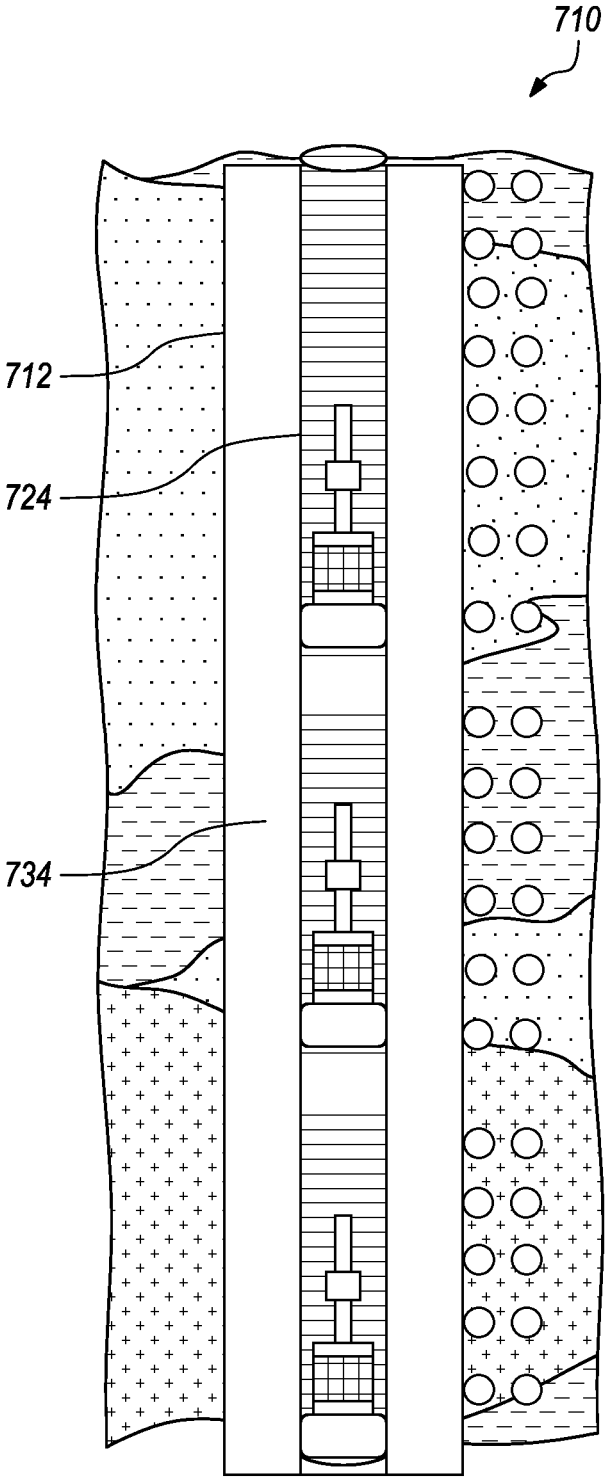
FIG. 7B is another simplified schematic illustration of the example of the groundwater flow and chemistry profiling system illustrated in FIG. 7A using temporary long-screened test wells, with a large diameter pilot hole.

FIG. 7A is a simplified schematic illustration of another example of the groundwater flow and chemistry profiling system 710 using temporary long-screened test wells 724, for use within a large diameter pilot hole 712 (illustrated in FIG. 7B). FIG. 7A also illustrates the pump 730 and packer assembly 738 that can be positioned within the test well 724. FIG. 7A further illustrates miniaturized technologies 740 that have been positioned within the test well 724. As shown, the miniaturized technologies 740 can be positioned within the test well 724 at a depth somewhat near the positioning of the pump 730 and packer assembly 738. The miniaturized technologies 740 are configured for purposes of profiling dynamic steady-state flow of the groundwater 732 within the test well 724, as well as providing samples of the groundwater 732 from within the test well 724 so that chemistry of the groundwater 732 can be determined. In various embodiments, as described in greater detail herein below, the miniaturized technologies 740 can be moved to different depths within the test well 724 so that dynamic steady-state flow and chemistry of the groundwater 732 can be determined for various depths within the test well 724.

FIG. 7B is another simplified schematic illustration of the example of the groundwater flow and chemistry profiling system 710 illustrated in FIG. 7A using temporary long-screened test wells 724, with a large diameter pilot hole 712. FIG. 7B also illustrates that, in some embodiments, the test well 724 can be constructed with a continuous gravel pack envelope 734 around the outside of the test well 724 and located between the test well 724 and the formation wall of the pilot hole 712.

More specifically, FIGS. 7A and 7B consists of drilling a large diameter pilot hole 712, such as measuring 14-inches or greater, or 17.5-inches or greater in diameter in some non-exclusive alternative embodiments, with reverse mud rotary drilling and installing a long-screened test well 724 that can be somewhat larger than the 6-inch to 8-inch diameter used within the small diameter pilot hole 612 illustrated and described above in relation to FIGS. 6A and 6B. In some embodiments, the test well 724 can be as large as approximately 10 inches or 12 inches in diameter, or even larger, when used within the large diameter pilot hole 712. This type of long-screened well can be 100 to many hundreds of feet long and is typically converted to a multi-level monitoring well or abandoned following completion of the testing. When using reverse mud rotary, as shown in FIGS. 7A and 7B, the long-screened test wells 724 are constructed 100-feet to 120-feet in length at a time so they can be removed from the pilot hole 712 when the testing is completed. The pilot hole 712 can then be backfilled with bentonite or cement to the next shallower testing level and a new 100-foot to 120-foot long-screened well is constructed. This process continues until sufficient saturated section has been profiled for zonal flow and chemistry.

It is appreciated that in such embodiments, the large-diameter pilot hole 712 can subsequently be enlarged through the reaming process and a large diameter production well installed when and if appropriate based on the testing that has been conducted within the test well 724.

Figure 8:
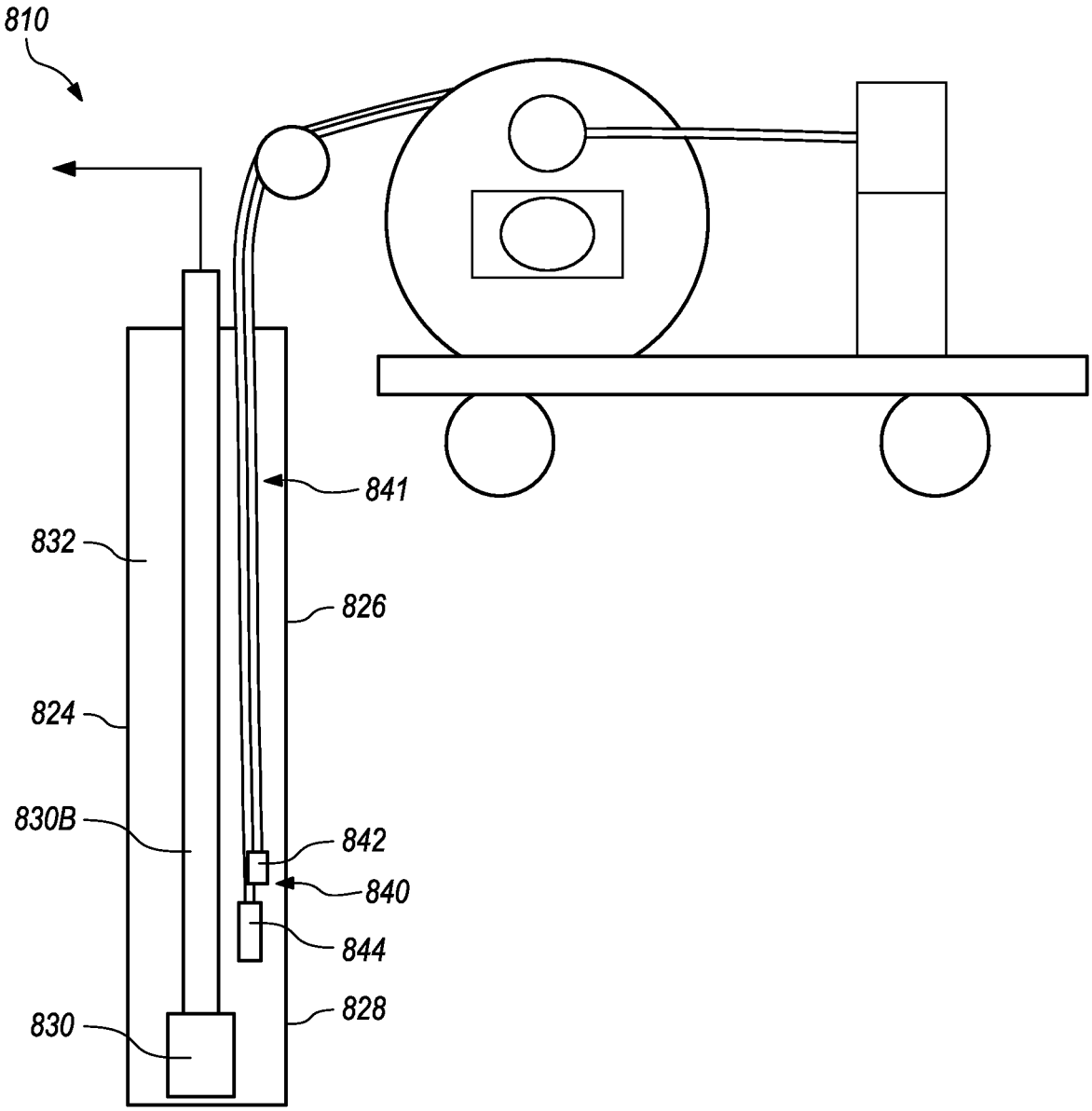
FIG. 8 is a simplified schematic illustration of miniaturized technologies positioned within the long-screened test wells usable as part of the groundwater flow and chemistry profiling system, the miniaturized technologies including a tracer injection system and a groundwater sampling system.

FIG. 8 is a simplified schematic illustration of miniaturized technologies 840 positioned within the long-screened test well 824 usable as part of the groundwater flow and chemistry profiling system 810. In particular, FIG. 8 illustrates the pump 830 positioned within the test well 824, and the miniaturized technologies 840 that are also positioned within the test well 824, such as within an annulus 841 between the pump column 830B and the support casing 826 and/or well screen 828 of the test well 824, for purposes of profiling the dynamic steady-state flow and chemistry of the groundwater 832 within the test well 824.

When using either of the long-screened test well approaches described, for example, in FIGS. 6A and 6B or FIGS. 7A and 7B, as part of the groundwater profiling system 810, the drill cuttings and/or the geophysical logs can be used to locate the screened intervals and to develop a Tracer Injection and Groundwater Sampling Plan in which the depths for tracer injection and groundwater sampling are identified in advance of the downhole testing.

The downhole testing performed is called dynamic, steady-state flow and chemistry testing. The testing is performed at a stabilized pumping rate and a stabilized draw down of groundwater 832 inside the test well 824 during the test such that there is minimal change in the pumping rate and pumping water level, typically equal to or less than a 5% change from the stabilized rate and depth used to perform the test.

In particular, in accordance with the Tracer Injection and Groundwater Sampling Plan that has been developed, the miniaturized technologies 840 incorporate a tracer injection system 842, which is configured to profile the dynamic steady-state flow of the groundwater 832 within the test well 824, and a groundwater sampling system 844, which is configured to profile the chemistry of the groundwater 832 within the test well 824. Details of various embodiments of the tracer injection system 842 will be described in detail herein below in relation to FIGS. 9A-9C. Details of various embodiments of the groundwater sampling system 844 will be described in detail herein below in relation to FIGS. 10A-10C.

When there is a continuous support casing structure, bentonite seals are emplaced in alignment with low permeability zones surrounding the test well 824 to inhibit transfer of contaminants between zones on the outside of the support casing. For large diameter pilot holes, bentonite seals can be placed on the top of the surrounding gravel pack envelope to seal the test well 824 from the pilot hole drilling mud during development. Both approaches can use an electric submersible pump to develop the drilling fluid leaked into the surrounding formation during the drilling process, clearing the groundwater 832 to a level where no visual turbidity is observed or measured to a low nephelometric unit (a measurement of fluid opacity) with an NTU meter.

In various embodiments, SDP uses the same or similar electric submersible pump that is used for developing the test well 824, but with the addition of a packer 438 (illustrated in FIG. 4), such as an inflatable packer in some embodiments, located at the bottom of the pump 830. In one implementation, the pump-packer assembly is placed near the bottom of (each) screened interval for each of the zonal flow and chemistry profiles and the SDP performed between the pump column 830B and the temporary support casing 826, using the miniaturized technologies 840, which can range from 0.50" to 0.88" in diameter in some non-exclusive embodiments. Alternatively, the miniaturized technologies 840 can be somewhat different in size in comparison to the specific values noted, such as equal to or less than approximately 1.5 inches in diameter, or equal to or less than approximately one inch in diameter.

When possible, it is advantageous to use a system where the tracer injection system 842 and the groundwater sampling system 844 are joined into a single, conjoined, downhole unit. There are two reasons as to why the use of this technology is beneficial when profiling long-screened test wells. First, only one depth counting into and out of the test well 824 is required, for one set of tooling. Conversely, two separate devices would require two depth countings and could potentially lead to depth dislocation errors where the counting of the tracer injection line is different from the groundwater sampling line, making it difficult to reconcile the tracer injection and groundwater sampling depths to a single location. Such counting errors can result in misidentifying depth intervals for zonal chemistry concentrations, leading to construction of a faulty well. FIG. 8 provides an example where the tracer injection system 842 and the groundwater sampling system 844 are miniaturized and bundled within a single jacketed assembly, thereby allowing the two tools to move in tandem with each other, through the same depth counting device simultaneously. The jacketing of the separate lines is also preferable to avoid entanglement of the lines downhole during the testing.

Although the profiling miniaturized technologies 840 are small and light in and of themselves, in some embodiments they can be weight-compensated by means of attaching strands of flexible, stainless-steel weights that weigh down the tubing inside the well while the test is being performed. These weights are typically ¾" in diameter by 3" to 4" long and shaped like a sausage, but also can be spherical as well with varying diameters from ¾" to 1.25".

In one implementation, testing begins by first placing the test pump 830 and packer assembly 438 near the bottom of the test well 824. The tubing for the miniaturized technologies 840 is then inserted into the anulus between the pump column 830B and the support casing 826 of the test well 824. A mechanical or optical counter is used to track the depth of deployment of the tubing bundle as it descends within the test well 824. Installing the pump 830 first has shown to be a safer approach as opposed to installing the tubing first and the pump 830 thereafter since the tubing runs the risk of being crushed or pinched as the pump 830 and pump column 830B descend to the target depth.

Returning to FIG. 2, at step 206, velocity and flow measurements of the groundwater are performed at the first depth within the test well with a tracer injection system.

Figure 9A:
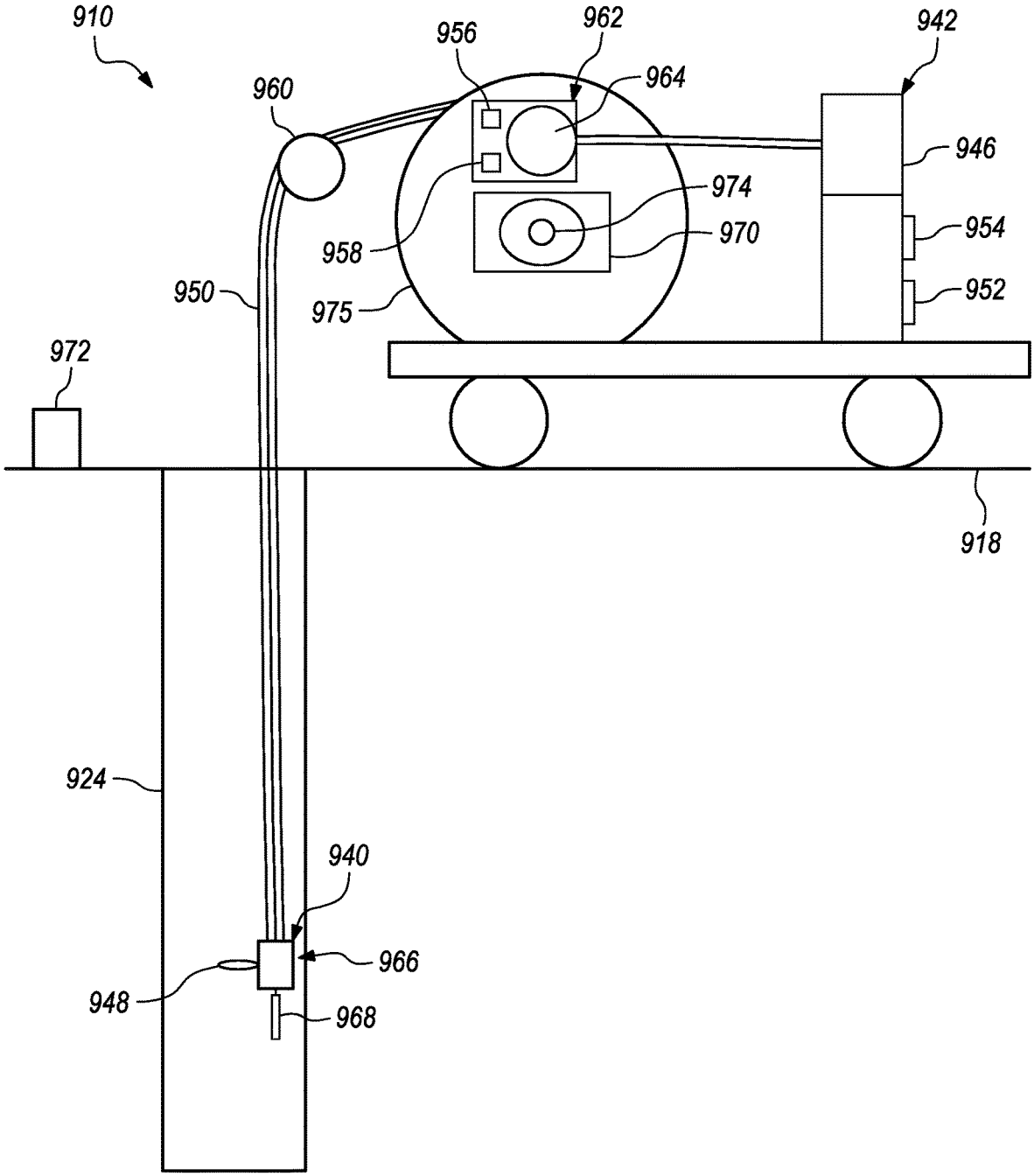
FIG. 9A is a simplified schematic illustration of the tracer injection system usable as part of the groundwater flow and chemistry profiling system.

Referring now to FIG. 9A, FIG. 9A is a simplified schematic illustration of an embodiment of the tracer injection system 942 usable as part of the miniaturized technologies 940 included as part of the groundwater flow and chemistry profiling system 910. More specifically, the tracer injection system 942 is configured to profile dynamic steady-state velocity and flow measurements of groundwater within the test well 924.

The design of the tracer injection system 942 can be varied to suit the requirements of the groundwater profiling system 910. In certain embodiments, the tracer injection system 942 can include one or more of a tracer reservoir 946 that retains a volume of tracer material 948, a tracer injection tube 950 (sometimes referred to simply as an "injection tube"), an injection motor 952, an injection pump 954, a solenoid 956, an actuator 958, switching valves 960, a tracer circulation system 962, a compressed gas source 964, an injection assembly 966, a weighting system 968, a timer control unit 970, and a tracer detector 972. Certain features and aspects of some non-exclusive embodiments of the injection assembly 966 are illustrated and described in greater detail in relation to FIG. 9B. Alternatively, in other embodiments, the tracer injection system 942 can have more components or fewer components than what is illustrated and described herein.

It is appreciated that the various components of the tracer injection system 942 can be positioned in any suitable manner. Thus, the positioning of any such components in the Figures is not intended to be limiting, except as recited in the claims.

The tracer reservoir 946 can be configured to provide any suitable type of a non-toxic, non-carcinogenic tracer material 948 for use within the tracer injection system 942. In one non-exclusive embodiment, the tracer material 948 used for each flow profile within the tracer injection system 942 can be rhodamine red FWT 50, which has been safely used for decades and is approved by the National Sanitation Foundation (NSF 60) for use in potable drinking water systems. Alternatively, another suitable and safe tracer material 948 can be utilized.

During use of the tracer injection system 942, the tracer reservoir 946 is used to supply and reload tracer material 948 to the tracer injection tube 950, airlessly, following each tracer injection. In particular, to prepare for profile flow testing, the tracer injection tube 950 is fully loaded with the tracer material 948 prior to testing. During testing, the tracer injection tube 950 is continuously reloaded so that the entire line is filled by means of a hydraulic reloading system, inhibiting air bubbles from forming in the line.

In various embodiments, the tracer injection system 942 is, at least in part, controlled by the timer control unit 970, which can be either a separate control unit that is electronically connected to the tracer injection system 942, or such system controlled by a field computer such as a laptop.

Within the tracer circulation system 962, when the timer control unit 970 is turned on, the timer control unit 970 activates the injection motor 952 which in turn activates the injection pump 954. Concurrently, the compressed gas source 964 is connected to the actuator 958 which in turn is connected to the solenoid 956. The compressed gas source 964 remains engaged at a fixed, regulated pressure the entire time, and such pressure is conveyed to open and close the switching valves 960 that allow the tracer material 948 to move under pressure through the tracer injection tube 950 or to circulate through the tracer injection system 942 and/or the tracer reservoir 946 when not injecting or idling.

In some embodiments, the timer control unit 970 can include a computerized system having one or more processors and circuits, and the timer control unit 970 can be programmed to perform one or more of the functions described herein. It is recognized that the positioning of the timer control unit 970 within the tracer injection system 942 can be varied depending upon the specific requirements of the tracer injection system 942. In other words, the positioning of the timer control unit 970 illustrated in FIG. 9A is not intended to be limiting in any manner.

The timer control unit 970 can control and/or regulate various processes related to the profiling of the flow of the groundwater 332 (illustrated in FIG. 3) at various desired depths within the test well 924. For example, the timer control unit 970 can be used to control the administration of the tracer injection system 942 within the test well 924, as well as for processing the results obtained from the tracer injection system 942 in order to calculate and/or derive the flow of the groundwater 332 at various depths within the test well 924.

The timer control unit 970 (or computer) can include a system activator 974, such as an injection button, such that when depressed electrically, it activates the solenoid 956 and in turn the actuator 958 so that the tracer material 948 can be released downhole, migrating through the switching valve 960 system, through the tracer injection tube 950 and then into the test well 924 via the injection assembly 966, which can be positioned at or near the end of the tracer injection tube 950 that is positioned at desired depths within the test well 924.

In certain embodiments, the injection assembly 966 can include an end-of-tubing control valve 976 (illustrated in FIG. 9B), which is configured to control release of the tracer material 948 into the groundwater 332 (illustrated in FIG. 3) within the test well 924. The end-of-tubing control valve 976 can also be used to inhibit the tracer material 948 from escaping or leaking into the test well 924 when between measurements. When the back pressure of the control valve 976 is overcome, the tracer material 948 is released into the test well 924 during an injection event when a velocity measurement is required.

During use of the tracer injection system 942, it is desired that the tracer injection tube 950 be filled with tracer material 948 such that there are no air bubbles in the tracer injection tube 950 that can interfere with the measurement of fluid velocities inside the test well 924. Since air bubbles can compress and expand, the presence of such bubbles creates delays in the release time that can vary from one injection depth to the next. When using the Continuity Equation to calculate return velocities from the release depth to the tracer detector 972, such as a ground-surface based fluorometer, such air bubbles can create minor to large errors when calculating cumulative and zonal flows and when integrated with the mass balance equation, such errors can create carry over errors in the flow weighting calculation process used to estimate chemical and elemental mass concentrations in the surrounding aquifer materials. Such time measurement errors due to airline bubbles can cause significant flow and mass balance calculation errors leading to erroneous data interpretation and, thus, erroneous final well design and construction. As such, the tracer injection system 942 must operate in such a way to inhibit the accumulation and entrainment of air bubbles inside the tracer injection system 942 and/or the tracer injection tube 950.

Thus, the timer control unit 970 can further be configured to inhibit air bubbles from entering into the tracer injection tube 950. Air bubbles can be problematic in that they can interfere with the recorded release time of the tracer material 948 into the test well 924. In other words, air bubbles can create a delay in the tracer release time since the air bubbles are compressible. As an example, if the tracer release time is 9:00:00 AM, the presence of air bubbles would likely cause a delay whereby the actual release time could be 9:00:05 AM, for instance. A difference of five seconds can provide a significant error in the volume of groundwater 332 that is calculated to enter the test well 924 between any two injection depths. Therefore, the timer control unit 970 works with the downhole portion of the tracer injection system 942 to make sure that the tracer injection tube 950 is sufficiently loaded with tracer material 948 and substantially absent, if not totally absent, of air. In order to prevent air from entering the tracer injection tube 950, the tracer material 948 can be fed to the tracer injection tube 950 via the tracer reservoir 946. In some embodiments, the tracer reservoir 946 is placed at an elevation that is higher than the tube reel 975 that stores the tracer injection tube 950. Gravity forces more tracer material 948 into the tracer injection tube 950. There can also be a fluid level meter (not shown) for the tracer material 948 on the outside of the tracer reservoir 946 such that the operator can always add more tracer material 948 when the tracer level descends to a trigger point inside the tracer reservoir 946. This process inhibits air from entering the tracer injection tube 950 from the tracer reservoir 946 being emptied.

During use of the tracer injection system 942, when the tracer material 948 is injected at any depth, the release time is time stamped by the tracer detector 972 and/or a computing device (such as a laptop, smart phone, tablet, or another suitable device) that is connected thereto, and can be manually entered by a field operator or automatically stored in the computing device. The return of the tracer material 948 to the tracer detector 972 at the surface 918 is also time stamped by the tracer detector 972 and/or by the computing device, and can be manually recorded on the field data sheet, or automatically stored in the computing device. As utilized herein, the return time or "return" for the tracer material 948 is the time when the tracer material 948 is specifically detected within the groundwater 332 by the tracer detector 972 as the groundwater 332 is pumped to the surface 918 through use of the pump 830 (illustrated in FIG. 8). Thus, as utilized herein, the "tracer detector" is any suitable device that allows measurement of ultra-low concentrations of the tracer material 948 in the groundwater 332 within the test well 924.

In some embodiments, to prepare the tracer injection system 942 for insertion into the test well 924, the weighting system 968, such as a tethered string of one or more weights (preferably formed from stainless steel metal), can be attached at or near the bottom of the tracer injection system 942. The weighted tracer injection tube 850 can be unwound from a tube reel 975 and can be inserted through the annulus 841 (illustrated in FIG. 8) and into the test well 924. In various applications, the weighting system 968 can be a valuable asset for the tracer injection system 942 in that it provides vertical stabilization and inertia for the tracer injection system 942 within a potentially turbulent test well, thereby helping to maintain a straight path of descent and egress with minimal swinging and winding as a result of fluid turbulence. Another advantage of the weighting system 968 is that since it can be comprised of multiple weights that are longer in the vertical direction and rounded at both ends, it is allowed to articulate within the test well 924 so as to radius around obstructions when performing the groundwater profiling tests. The weights themselves are typically small in diameter, ranging from one-quarter inch outer diameter to as much as one-inch outer diameter and are typically three to four inches in length and rounded on both ends of the weight to eliminate sharp angles that may be spatially disruptive to descent and egress from the test well 924. In some embodiments, each weight is bored through the center such that a support cable, such as a stainless-steel support cable, can be threaded through and then terminated at the base of the cable where it exits the last weight located at the end of the weighting system 968.

Figure 9B:
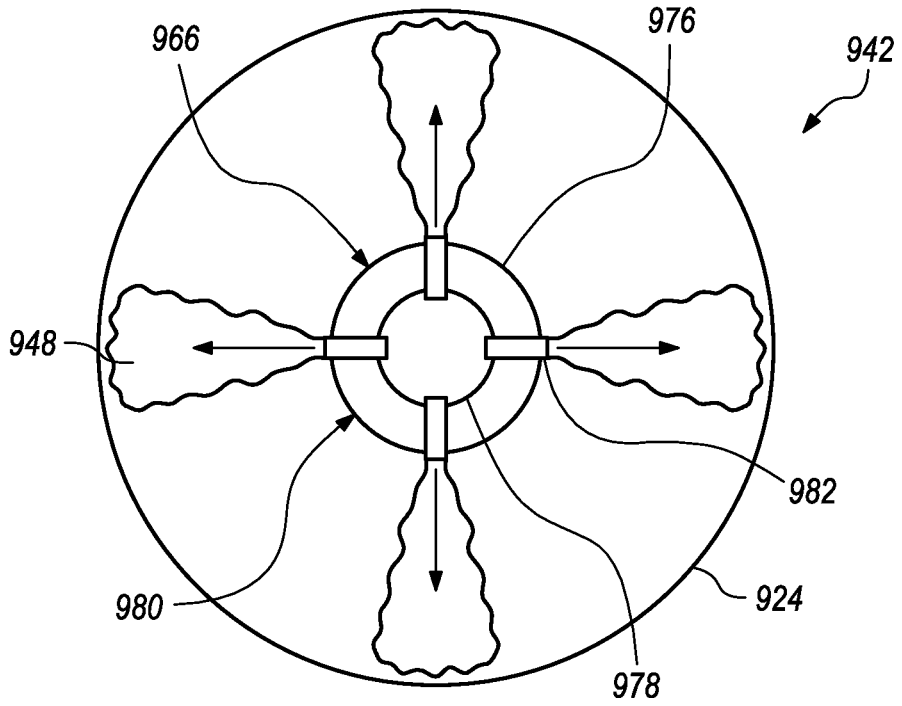
FIG. 9B is a simplified schematic illustration of a portion of the tracer injection system illustrated in FIG. 9A.

FIG. 9B is a simplified schematic illustration of a portion of the tracer injection 942 system illustrated in FIG. 9A. In particular, FIG. 9B illustrates a simplified schematic top view of the injection assembly 966 that is used to inject the tracer material 948 into the test well 924 at desired depths.

The design of the injection assembly 966 can be varied to suit the requirements of the groundwater profiling system 910 and/or the tracer injection system 942. In certain embodiments, as shown in FIG. 9B, the injection assembly 966 can include one or more of an injection cylinder 978, an injection port 980, the control valve 976, and a plurality of exit holes 982. Alternatively, the injection assembly 966 can include more components or fewer components than what is illustrated and described herein.

To improve the accuracy of each tracer injection transit time between the tracer release and up hole tracer detection points, sideways injection from the injection assembly 966 is used downhole and is preferred for obtaining accurate tracer travel times. Ideally, flowmeter surveys are supposed to be centralized within the pilot hole 312 (illustrated in FIG. 3) or test well 924 for the purpose of applying a correction coefficient that considers the vectoral shape of groundwater flow inside of a pipe.

Within the test well 924, there is axial flow, transitional flow and boundary flow regimes. Axial flow is the fastest and boundary flow the slowest and as such, when flow metering a substantially cylindrical test well 924, the flow algorithm should consider these conditions to calculate a bulk average flow rate. Since a pump column 830B (illustrated in FIG. 8) is located in approximately the center of the test well 924, the axial flow cannot be measured. However, the annular flow between the pump column 830B and support casing 826 (illustrated in FIG. 8) and well screen 828 (illustrated in FIG. 8) is not entirely uniform and can vary circumferentially around the test well 924 due to off-centering of the pump column 830B due to the deviation of the test well 924 or the pump column 830B. Therefore, it is important that flow in the annulus 841 (illustrated in FIG. 8), on different sides of the pump column 830B, at each injection point be considered in the flow calculation when using the continuity equation. Therefore, sideways injection of the tracer material 948 includes multiple release points and horizontal vectors that encompass the entire annulus 841 between the pump column 830B and the support casing 826 and well screen 828 such that a bulk average flow rate can be calculated at each tracer injection depth.

Sideways injection is accompanied by two important features of the tracer injection system 942. First, as noted, the tracer injection system 942 is of such design that air bubbles are inhibited and/or removed from injection manifold and the tracer injection tube 950 (illustrated in FIG. 9A). The presence of air bubbles can cause significant inaccuracies in tracer return times and flow calculations due to the compressibility of the air inside the tracer injection system 942, such compressibility causing delays in the release of the tracer material 948 downhole and computational inaccuracies that create significant errors. As the size and number of air bubbles in the tracer injection system 942 grow, so do the computational errors. Therefore, the tracer injection system 942 is equipped with an air purging apparatus to inhibit and/or prevent the existence of such bubbles. The second component that is important to tracer travel time computations is that the release of the tracer material 948 must be substantially instantaneous. To achieve instantaneous release of the tracer material 948, there are two requirements. First, the tracer injection tube 950 should have minimal elasticity to minimize dilation of the tubing material during injection of the tracer material 948, where such dilation causes a delay in the release of the tracer material 948. And second, the release of the tracer material 948 is controlled by an electronically controlled actuator that can forcibly push the tracer material 948 through the injection assembly 966 on command by means of the electronically controlled injection timer control unit 970 (illustrated in FIG. 9A).

As described, the sideways Injection is utilized for acquiring accurate downhole velocity measurements and flow calculations. Since tooling centralization for standard spinner flowmeter surveys is required and the set up for production wells and long-screened test wells generally inhibits centralization (because the pump column structure is in the way) the sideways injection method can be an extremely valuable ingredient for performing a successful flow survey as well as accurate mass balance calculations for zonal chemistry. Sideways injection allows the tracer material 948 to substantially instantaneously flood the entire annulus 841 around and between the pump column 830B and the support casing 826 (the donut-shaped area) such that the annular cross-sectional area of the "donut" is factored into the flow calculation when using the Continuity Equation. This is an impossible achievement with a spinner logging tool or any other rigid, elongated velocity measurement device since these instruments can only be located on one side of the pump column 830B at any one time and not everywhere within the annulus 841 at the same time as the tracer material 948 can.

Thus, in various embodiments, the injection assembly 966 is configured such that the tracer material 948 is injected substantially horizontally or sideways from multiple exit holes 982 in order to measure flow of the groundwater 332 (illustrated in FIG. 3) through the entire cross-sectional plane of the test well 924 at any desired depth. In certain embodiments, the tracer material 948 is injected substantially orthogonal to a longitudinal axis 324X (illustrated in FIG. 3) of the support casing 826. With such design, there is no need to specifically centralize the tracer injection system 942 within the test well 924 while still enabling an accurate flow profile, i.e. zonal flow, through the entire cross-sectional plane of the test well 924. In many embodiments, the flow profiling can be undertaken with the pump 830B operating so as to provide the actual pumping rate and geometry to create the desired dynamic steady-state flow of the groundwater 332 inside the test well 924.

As utilized herein, the reference to the tracer material 948 being injected substantially "horizontally" or "sideways" signifies that the tracer material 948 is being injected substantially perpendicular (or orthogonal) relative to the longitudinal axis 324X of the support casing 826 or well screen 828 of the test well 924 at the point of injection. Additionally, a substantially horizontal injection of the tracer material 948 further signifies that the tracer material 948 is being directed substantially directly from the injection port 980 toward the support casing 826 or well screen 828 in the specific direction that the tracer material 948 is being directed and at the point or depth of injection.

In certain embodiments, the injection port 980 includes a small diameter (e.g., less than one inch), short, one-way control valve 976 (less than three inches long) that is connected to an injection cylinder 978 of the same or smaller diameter, and that is shorter in length than the control valve 976. The injection cylinder 976 has an open side that is attached to the bottom end of the control valve 976. The bottom, opposite side of the injection cylinder 978 is covered, with no exit point. The curved wall of the injection cylinder 978 has multiple exit holes 982 that are circumferentially spaced around the injection cylinder 978. These exit holes 982 allow the tracer material 948 to exit the injection cylinder 978, simultaneously at multiple points, and in a substantially horizontal or "sideways" direction into the test well 924 at each point. The substantially horizontal, radial release of the tracer material 948 through multiple exit holes 982 around the small injection cylinder 978 allows a substantial, if not the entire, cross-sectional area of the test well 924 to be filled or flooded with the tracer material 948 to enable the bulk average flow rate of groundwater 332 through this plane to be measured. With this design, the bulk average flow rate of the groundwater 332 can still be effectively measured even when the injection port 980 is not centralized inside the test well 924. As the tracer material 948 radially spreads through the groundwater 332 at any injection depth, the tracer material 948 almost instantly covers groundwater 332 moving through the boundary layer, the transitional zone and the axial trace of a pumping test well 924.

The number of exit holes 982 through which the tracer material 948 is injected into the test well 924 can be varied. For example, as illustrated in FIG. 9B, the injection cylinder 978 can include four exit holes 982 through which the tracer material 948 is injected into the test well 942. Alternatively, the injection cylinder 978 can include more than or less than four exit holes 982. In certain non-exclusive alternative embodiments, the injection cylinder 978 can include two, three, five, six, seven, eight, nine or ten exit holes 982 through which the tracer material 948 is injected into the test well 924. As noted, the use of multiple exit holes 982 better enables the tracer material 948 to fill most if not all of the cross-sectional area of the test well 924, which better enables the tracer injection system 942 to accurately measure the bulk average flow rate of the groundwater 332 at the various desired depths within the test well 924.

Returning to FIG. 2, at step 207, groundwater samples are removed from the first depth within the test well with a groundwater sampling system to identify a chemistry of the groundwater at the first depth.

Figure 10A:
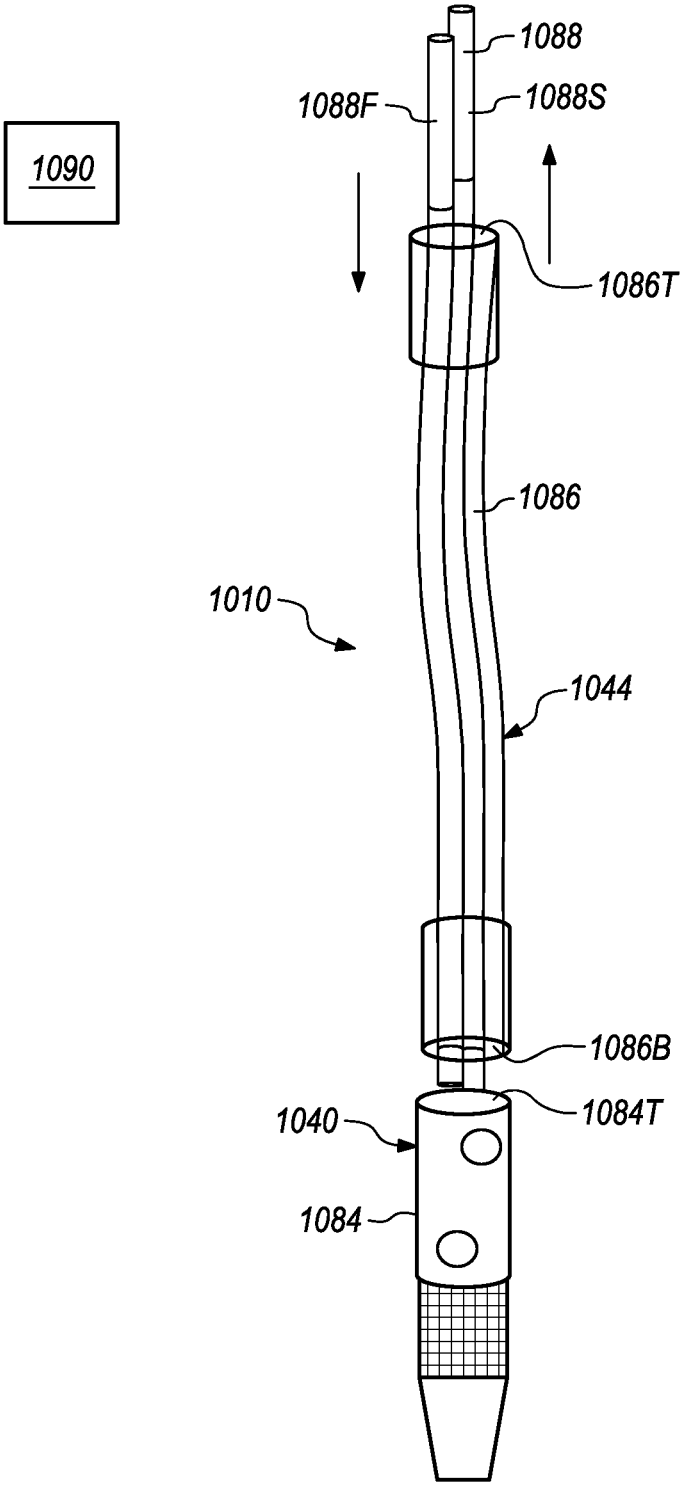
FIG. 10A is a simplified schematic illustration of an embodiment of the groundwater sampling system usable as part of the groundwater flow and chemistry profiling system.

Referring now to FIG. 10A, FIG. 10A is a simplified schematic illustration of an embodiment of the groundwater sampling system 1044 usable as part of the groundwater flow and chemistry profiling system 1010. More specifically, the groundwater sampling system 1044 is configured to profile the chemistry of the groundwater 832 (illustrated in FIG. 8) within the test well 824 (illustrated in FIG. 8).

In some embodiments, if the tracer injection tube 950 (illustrated in FIG. 9A) of the tracer injection system 942 (illustrated in FIG. 9A) is conjoined with coiled tubing 1088 of the groundwater sampling system 1044, then a depth-dependent groundwater sample can be collected concurrently or immediately following the velocity measurement before moving to the next depth inside the test well 824 (illustrated in FIG. 8).

Conversely, in other implementations, the entire tracer velocity and flow survey can be completed first and then each or some of the locations revisited to collect the depth-dependent groundwater samples.

Still alternatively, if desired, in some implementations, the depth-dependent groundwater samples can be collected first, particularly in situations where the time of the sampling effort is limited due to shipping cutoff times or lab receival times.

In some cases, the tracer injection survey is performed first within each pump-packer tranche since the velocity and flow data is used to refine the selection of the depth-dependent sample locations. In this scenario, once the first vertical tranche or section of the flow survey is completed inside the test well 824, the corresponding depth-dependent groundwater sampling survey can begin.

In any of the depth-dependent groundwater sampling scenarios described above, the miniaturized technologies 1040 can be configured to incorporate a miniaturized sampler that is used such that it easily fits and can transit within the annulus 841 between the pump column 830B (illustrated in FIG. 8), and the support casing 826 (illustrated in FIG. 8) and/or well screen 828 (illustrated in FIG. 8). The first groundwater sample can be taken at the first tracer injection location near the top of the pump 830 (illustrated in FIG. 8), or even at the furthest location above the pump 830 where there was a tracer return to the surface-based tracer detector 972 (illustrated in FIG. 9A), or fluorometer. In various applications, the depth-dependent groundwater samples are collocated with the tracer injection depths.

The miniaturized groundwater sampling system 1044, with miniaturized sampling pump assembly and related tubing can be either conjoined to the tracer injection tube 950 as a unified system where both transit together simultaneously as a singular unit up and down the annulus 841 of the test well 824, or as two separate units. However, if there is enough annular space, it is preferred to run a conjoined system for two reasons. First, there is a phenomenon called counter error, caused by slippage of the tubing as it runs through the counter or by malfunction of the counter's metering system. If two separate lines are run, one for the tracer injection tube 950 and the other for the coiled tubing 1088 of the groundwater sampling system 1044, there is a possibility that two separate counter errors occur, and if this happens, it often results in vertical dislocation of the tracer injection and sampling depth. Ideally, they are supposed to be collocated such that the data pair can be used to perform a mass balance calculation with a sequentially located pair to derive a mass balance estimate of chemical concentration in the surrounding formation. If the tracer injection and sampling pair are vertically dislocated, then a mass balance error can occur, mismatching zonal flow and chemistry and potentially resulting in an incorrect estimate of contaminant mass for that zone. As such, the water supply well that is constructed on the basis of these estimates can be improperly constructed, with well screens being aligned with contaminated zones when the intention of the zonal flow and chemistry survey was to avoid build screens or perforations within these zones. For this reason, it is theoretically easier to reconcile one counter error as opposed to two counter errors if such error should occur. The other reason for using a unified system is that there is a time savings by only "tripping" one tubing assembly into the test well 824 as opposed to two. Even if the time savings is only one-half day, it is important when the scientific team spends a great deal of time in the field and that part of their time is supposed to be for travel to and from the site. Moreover, project schedule is important from a budget standpoint and to keep the customer satisfied that the operation is being performed in a timely manner.

The design of the groundwater sampling system 1044 can be varied to suit the requirements of the groundwater profiling system 1010. As illustrated in the embodiment shown in FIG. 10A, the groundwater sampling system 1044 includes a sampling pump 1084, such as a miniaturized double-valve pump, a volume booster 1086, and a long section of jacketed, coiled tubing 1088. Alternatively, the groundwater sampling system 1044 can have a different design and/or can include more components or fewer components than what is specifically shown in FIG. 10A As illustrated, the sampling pump 1084 and the volume booster 1086 are coupled together, with the volume booster 1086 being coupled to a top 1084T of the sampling pump 1084. The sampling pump 1084 is illustrated in and will be described in greater detail in relation to FIG. 10B. Similarly, the volume booster 1086 is illustrated in and will be described in greater detail in relation to FIG. 10C.

The coiled tubing 1088 runs from the ground surface 318 (illustrated in FIG. 3) to a top 1086T of the volume booster 1086, and a bottom 1086B of the volume booster 1086 connects to the top 1084T of the sampling pump 1084. The coiled tubing 1088 can be made from any suitable material, but is typically constructed from low pressure to high pressure Nylon, HDPE or Teflon polymers, depending on sampling depth and the type(s) of contaminants that are being searched for. The coiled tubing 1088 can also be made from various types of metals, including stainless-steel for deep applications where sampling pressures required to lift groundwater 832 to the surface 318 exceed those of high-pressure polymer tubing. The coiled tubing 1088 is typically mounted to a mechanical, hand-powered or motorized hose reel that can deploy and retrieve the coiled tubing 1088. The coiled tubing 1088 itself consists of two separate strands that run parallel to each other, preferably inside of a plastic jacket that keeps the two lines from separating during deployment and retrieval from the test well 824 or pilot hole 312 (illustrated in FIG. 3). Embedded within the jacket is a stainless-steel or ordinary steel safety cable that runs the entire length of the coiled tubing 1088, its purpose being to support the weight of the volume booster 1086 and sampling pump 1084 located together at the bottom of the coiled tubing 1088 by means of crimped ferrules or safety quick links that join the coiled tubing 1088 to the volume booster 1086.

As mentioned, there are two lines within the jacketed coiled tubing 1088. A first line 1088F delivers compressed gas from the surface 318, and a second line 1088S transfers groundwater 832 from the targeted sampling depth to the surface 318. The compressed gas is typically connected to an electrically powered timer control unit 1090 at the surface 318, but can be manually controlled as well. The purpose of the electronic or manual control is to cycle the gas pressure down the coiled tubing 1088, through the volume booster 1086 and to the sampling pump 1084 in order to push groundwater 832 to the surface 318, and then to turn off the compressed gas source to allow the coiled tubing 1088 to recover more water and refill (the off cycle) following the gas-on cycle.

In certain embodiments, the compressed gas-on and gas-off cycles, combined with the timer control unit 1090, the coiled tubing 1088, the volume booster 1086 and the sampling pump 1084 make up the entire groundwater sampling system 1044 being used with stacked dynamic profiling. The benefit of such approach is the elimination of wires to control an electrically operated pump since wires are difficult and expensive to repair in the field during a profiling survey. Moreover, the double-valve sampling pump 1084 also has an advantage in not using a bladder or bladder pump. The limitation of a bladder pump is the bladder itself, which is typically made from a plastic poly material that expands and contract like a lung. When the bladder inflates by means of a gas-in line, the expanding bladder displaces water inside of a holding chamber up into the sample return line where, after repeated cycles, the groundwater eventually exits the sample return line at the surface. Repeated inflation and deflation cycles apply wear and tear stresses on the bladder to the point where it tears and requires replacement. Moreover, at deeper depths, and as targeted sample depths become deeper and deeper, the bladder has increasing difficulty in overcoming the hydraulic head pressure from the lengthening fluid column inside the pilot hole 312 or test well 824, to the point where expansion is laborious and slow moving, making the fluid velocity inside the sample return line slower and slower. As such more purge and sampling time is required. Lastly, use of an inflating and deflating bladder requires significantly more energy to operate compared to the double-valve sampling pump without a bladder, such that significantly more compressed gas is used to operate the system when compared to a double-valve pump. Thus, the double-valve sampling pump requires no electrical wiring, requires no internal bladder, and operates with maximum efficiencies down hole, and even with increasing depths, using compressed gas.

Figure 10B:
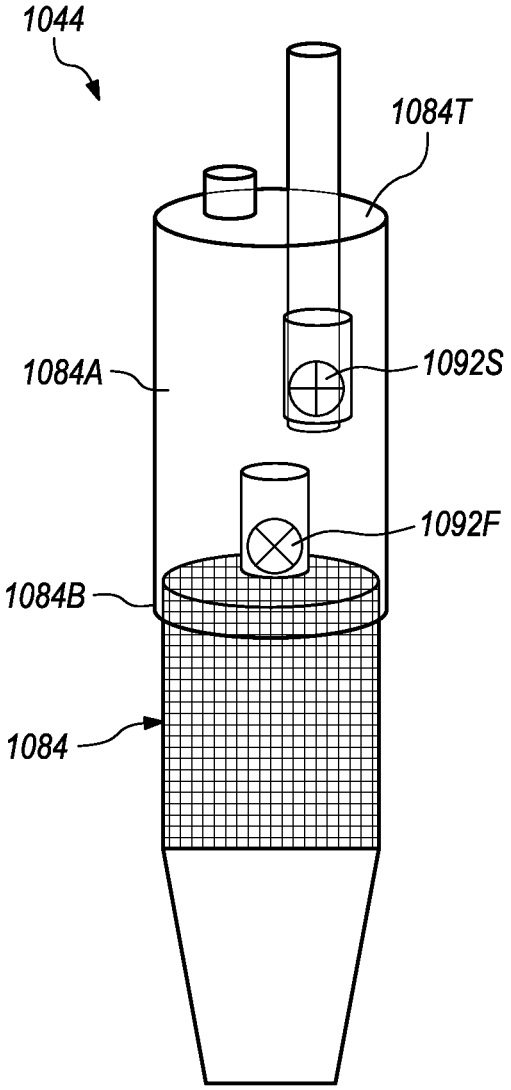
FIG. 10B is a simplified schematic illustration of a portion of the groundwater sampling system illustrated in FIG. 10A.

FIG. 10B is a simplified schematic illustration of a portion of the groundwater sampling system 1044 illustrated in FIG. 10A. More specifically, FIG. 10B is a simplified schematic illustration of an embodiment of the sampling pump 1084 that be included as part of the groundwater sampling system 1044.

The referenced double-valve sampling pump 1084 is preferably operated using compressed gas but can also be operated with a bladder or even electrically if desired. In various embodiments, the sampling pump 1084 being used can typically be 1.25 inches or smaller in diameter, and can typically be four inches to ten inches in length. The slim design of the sampling pump 1084 is preferred to facilitate ease of passage or transit between the pump column 830B (illustrated in FIG. 8) and the support casing 826 (illustrated in FIG. 8) and/or well screen 828 (illustrated in FIG. 8) of the long-screened test well 824 (illustrated in FIG. 8). The miniaturized sampling pump 1084 that is used can have varying lift capacities, dependent on the types of materials used to construct the miniaturized sampling pump 1084, but when using materials that are designed for very high compressed gas operational pressures, the sampling pump 1084 can have a lift capacity up to 4,000 feet below ground surface.

In many embodiments, as noted, the sampling pump 1084 consists of a two-valve system, including a first valve 1092F, which is sometimes referred to as a "foot valve", and a second valve 1092S, which is sometimes referred to as a "sample return line valve". The first valve 1092F is located near a base 1084B of the pump body 1084A, and the second valve 1092S is located just below the top 1084T of the pump body 1084A, located inside of a water storage chamber that provides added volume to each pump cycle.

The miniaturized sampling pump 1084 runs off compressed gas and such gas can consist of atmospheric (air) or a pure gas such as nitrogen, helium or argon, or any other inert gas. Release of the gas is manually operated or controlled with an electronic timer control unit 1090 (illustrated in FIG. 10A) with an on-off actuator system and pressure control regulator. Such timer control unit 1090 is programmable to set any on- and off-time duration required to cycle groundwater 832 (illustrated in FIG. 8) back to the surface 318 (illustrated in FIG. 3). High pressure tubing is used in combination with said sampling pump 1084 and timer control unit 1090 such that any required pump depth can be achieved. When compressed gas is released into the system, the gas enters the gas-in line and pushes down on the groundwater 832 in that line. The load-pressure is translated hydraulically to the first (foot) valve 1092F, forcing the first valve 1092F to close, and the groundwater 832 from the gas-in line to perform a U-turn inside the miniaturized sampling pump 1084, where such groundwater 832 is then forced upwards through the second (sample return line) valve 1092S and into the sample return line. Multiple repetitions of this cycle force the groundwater 832 to the surface 318 where it discharges into a container, either to hold purge water or for groundwater samples. When enough groundwater sample has been collected, the miniaturized sampling pump 1084 is moved to the next sampling depth. The cycle is repeated, whereby the system is first purged two to three times to remove older water from the previous sampling event as well as to refresh the system with groundwater from the new depth.

Figure 10C:
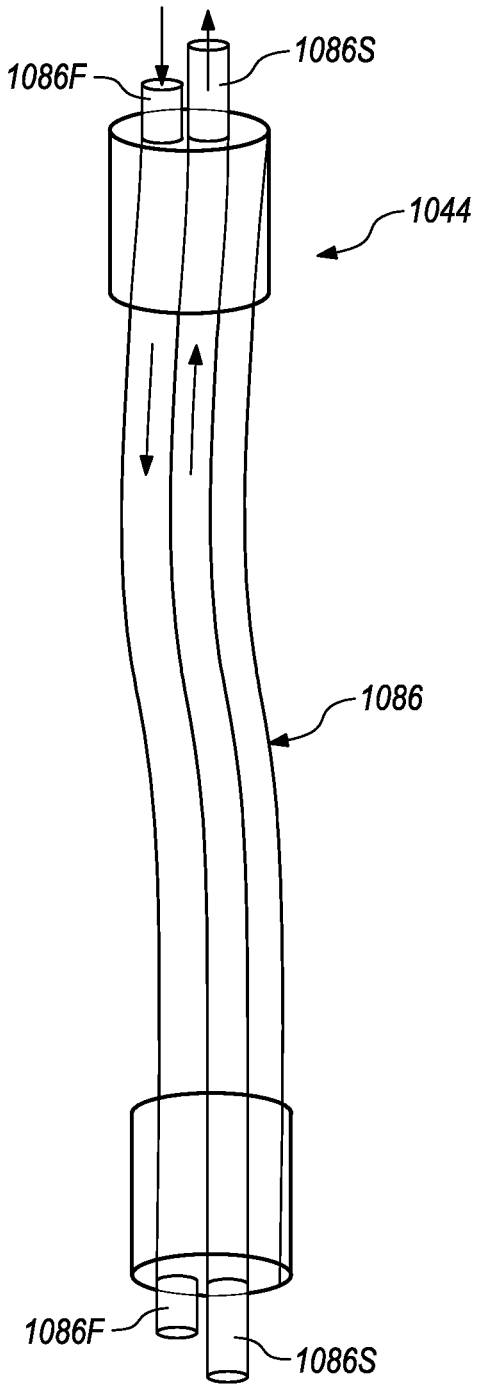
FIG. 10C is a simplified schematic illustration of another portion of the groundwater sampling system illustrated in FIG. 10A.

FIG. 10C is a simplified schematic illustration of another portion of the groundwater sampling system 1044 illustrated in FIG. 10A. More specifically, FIG. 10C is a simplified schematic illustration of an embodiment of the volume booster 1086 that can be included as part of the groundwater sampling system 1044.

In cases where there is insufficient submergence below the pumping water level for the groundwater sampling system 1044 to operate efficiently, the volume booster 1086 can be employed with the sampling pump 1084 (illustrated in FIG. 10A). The volume booster 1086, as its name implies, increases the volume per foot of tubing to increase the purge volume and sample volume on a single pump stroke. For example, if the sampling requirement is to collect 2-liters of groundwater from each depth, and the miniaturized sampling pump 1084 is placed only 30-feet below the pumping water level, and the gas-in and sample return line only stores 180 milliliters, then up to ten or more pumping cycles would be required to achieve that volume. More than ten cycles would likely be required since a portion of the groundwater sticks to the inside of the tubing as it returns to the ground surface 318 (illustrated in FIG. 3), whereby the actual discharge volume per pump stroke could be considerably less than the theoretical volume stored inside the tubing. This problem becomes exacerbated on deep pilot holes and test wells, where excess tubing is coiled onto a hose reel, as the sampler ascends up the test well, moving to a shallower location each time. The coil friction inside the tubing is greater than the straight friction when the line is deployed inside the test well, causing more water to stick inside the coil than inside the straight length of tubing. This reduces the purge and sample volume even further.

The volume booster 1086 can be either of coaxial or parallel design, but preferably coaxial since its features are slimmer and less prone to getting stuck or smashed against pipe collars on the pump column when a parallel, side-by-side configuration is used. But either design can be of any length, and most commonly 10 to 40 feet long. The coaxial design consists of a tube inside of a tube. The outer tube has a relatively large inside diameter (i.e., ½ inch or ¾ inch) considering its miniaturized scale and the smaller tubing passing through the larger tube has an outside diameter of ¼ inch or 3/16 inch and an inside diameter of 3/16 inch to ⅛ inch. The annulus between the inner and outer tubing is where the extra volume of groundwater is stored. Each end of the volume booster 1086 is outfitted with a rigid fixture with two portals, one portal being connected to the gas-in line and the other portal being connected to the sample return line. The fixtures can be made from plastic or metal and both end fixtures have two tube connection ports, a first port 1086F for compressed gas and a second port 1086S for sample return.

Compressed gas pressure, released from the surface 318, travels down the gas-in line of a jacketed tubing bundle until it reaches the complimentary first (gas-in) port 1086F of the volume booster 1086. There are two lines in the jacketed tubing bundle, one for compressed gas transfer and the other tube for return of purge and sample water from the targeted sampling depth. Compressed gas from the gas-in line pushes down on the stored groundwater inside the volume booster 1086 forcing this groundwater through the miniaturized sampling pump 1084. As the groundwater transits through the miniaturized sampling pump 1084, the hydraulic load from the compressed gas forces the poppet inside the first valve 1092F (illustrated in FIG. 10B) to close, and as such, performs a U-turn inside the sampling pump 1084 where it travels upwards through the second valve 1092S (illustrated in FIG. 10B) and through the inner tube of the volume booster 1086. Upon exiting the top of the volume booster 1086, the groundwater 832 then travels through the sample return line of the coiled tubing 1088 (illustrated in FIG. 10A) back to the ground surface 318 where the purge water and samples are collected in containers. The use of the volume booster 1086 is an important feature to an efficient groundwater sampling program when profiling long-screened test wells, reducing the sampling time by up to one-half the time required if the volume booster is not used.

In some embodiments, the surface assembly during the test can include a discharge pipe for the pumped groundwater as well as a flow meter and groundwater sample tap for collecting whole groundwater samples used in the mass balance calculation. The flowmeter and sample tap are preferably located 7 to 10 pipe diameters from the pilot hole 312 (illustrated in FIG. 3) to inhibit turbulence in the line during flow metering of the discharge pipe.

During the test, the water level is being monitored in the test well 824 (illustrated in FIG. 8) using a water level meter or transducer to determine when the pumping water level has reached a steady-state drawdown level. The pumping rate is also monitored contemporaneously to ensure that there is little fluctuation and is the second condition required to reach a steady-state condition.

In summary, groundwater samples can be collected with a small, miniaturized sampling pump that employs a gas-drive purging and sampling process that is differentiated from an air-lift system by the fact that there is no gas introduced into the stream during sample collection. In contrast to air lifting, a gas-drive pump allows the gas to push against the top-end of the water column inside the gas-in tubing line and drives the water column through a U-turn inside the sampling pump when under pressure. Simultaneously, the pneumatic pressure of the gas forces the pump's foot valve to seat and seal against an O-ring located near the base of the sampling pump during the purge and sample cycle. During this process, groundwater in the gas-in line is driven seamlessly with the conjoined water column inside the sample return line. The two combined volumes rise inside the sample return line under pressure and exit the same return line at the surface. Groundwater exiting the sample return line flows in a smooth continuous stream until all groundwater volume from both lines are evacuated from the system. The gas pressure is then bled off by switching a three-way valve at the surface that allows both the gas-in and sample return lines to recharge with groundwater from the sample collection depth under hydrostatic pressure. Alternatively, another suitable pump can be used that employs a different purging and sampling process.

The purging process at each sample depth consists of two complete line purges using a standard Fast Purge Mode (FPM). The first purge cycle of the FPM clears the water from pilot hole transit and from the previous sampling depth. The second purge cycle clears the water from the new sampling depth, internally washing the tubing with groundwater from the new depth. The third pumping cycle is then used to collect the groundwater sample from the new target depth.

The third pumping cycle, which is used to collect the water samples, can be operated in one of two modes. The FPM is used when inert constituents such as metals, semi-metals, radionuclides, etc., are to be sampled. A ratchet mode (RM) is used for analytes where concentration stability is sensitive to change in pressure and temperature, such as VOCs and dissolved gases. When this is the case, a Timer Control Unit (TCU) is used to incrementally drive groundwater through the sample return line in a manner that is very similar to the operation of a bladder pump. The key difference is that there is no bladder in the gas-drive pump, allowing for a greater hydraulic lift and faster return cycle to the surface than a bladder or small electric submersible pump. The TCU cycles pressurized nitrogen gas onto the water interface inside the gas-in line located above the pump. The on-off cycle action moves the gas-water interface up and down the same distance by means of a solenoid gate valve located inside the TCU. The process is analogous to how a foot jack operates when changing a car tire whereby the ratcheting action of the gas-water interface inside the gas-in line is equivalent to the foot lever on the jack that travels the same vertical distance up and down. Each stroke of the foot lever raises the jack which in turn lifts the car. The incrementally rising jack and car is analogous to the water column rising in the sample return line.

Returning to FIG. 2, at step 208, additional velocity and flow measurements of the groundwater are performed, and additional groundwater samples are removed from different depths within the test well to determine the dynamic steady-state flow and chemistry of the groundwater within the test well.

The dynamic, steady-state profiling of the long-screened test well commences following well development. Test wells are typically smaller in diameter and use smaller diameter pumps and fewer bowl stages that typically cannot hydraulically engage the entire well screen, as compared to most municipal, industrial supply and agricultural wells. Therefore, in the test wells, the pump must be moved from one depth location to the next, performing multiple, stacked dynamic profiles.

In various implementations, the first velocity and flow measurements of the groundwater, and the removing of groundwater samples, are initially conducted with the miniaturized technologies of the tracer injection system and the groundwater profiling system at a first depth that is at or near the bottom of the test well. Subsequently, additional velocity and flow measurements of the groundwater, and additional removal of groundwater samples, are performed at different depths within the test well by gradually moving the miniaturized technologies of the tracer injection system and the groundwater profiling system upward in steps toward the top of the test well. The general process of starting at or near the bottom of the test well and moving upward to different discrete depths, and then calculating and/or determining the dynamic steady-state flow and chemistry of the groundwater within the test well based on the measurements and samples taken therefrom will now be described in greater detail.

When starting at the bottom of the test well, the packer assembly is not necessarily inflated, since there is no well screen or minimal well screen below the packer assembly to be profiled and therefore there is little to no hydraulic influence or water chemistry influence to be measured below the pump and packer assembly. However, the packer assembly will typically be inflated at all shallower depth locations to inhibit losing hydraulic capture energy to deeper screened sections that were previously profiled. This technical approach was developed since one of the goals of the SDP method is to use as few pump locations as necessary to complete the testing.

As such, when starting from the bottom of the test well, the injection assembly of the tracer injection system is typically placed in close proximity to the top of the pump and a first volume of tracer material is released into the test well where it is then pulled down towards the pump's intake. The time of release of the tracer material is recorded and the time of return detection to the ground-surface based tracer detector also recorded. Following the first injection, the injection assembly is moved to the next shallowest depth as shown on the Tracer Injection and Groundwater Sampling Plan and a small volume of tracer material is released once again. The distances between the first and second, second and third, third and fourth injections, and so on can be any, with the purpose of each sequential pair of injections to determine the zonal flow entering the test well between each pair of injection points. This process continues until there is no return of the tracer material following the injection. This indicates that the tracer material was released at a depth location that was vertically above the pump's hydraulic capture distance within the test well.

In some cases, the purpose of the dynamic survey is to only determine the distribution of the material's hydraulic properties, such as zonal flow as mentioned above. However, in other cases, the dynamic survey may also include using such data to determine estimates of zonal hydraulic conductivity and transmissivity using various algorithms such as the Moltz Equation or other similar equations. All of these hydraulic properties can also be collected with complimentary, collocated, depth-dependent groundwater samples such that the geochemical properties and contaminant characteristics of one or more water bearing units can be defined.

Following the completion of the first tranche, the pump and packer assembly is then moved to or near the location where there was no detectable return of the tracer material, determined on the first tranche, by lifting the pump column and removing sections of pump column until the next target depth is reached. If using an inflatable packer, the packer is inflated at the second location to inhibit the pump from pulling water from below the packer assembly, which constitutes a section of the test well already profiled. By employing this strategy, most if not all of the hydraulic force of the pump is forced upwards, or up hole, above the pump and packer assembly, such that a maximum vertical distance of formation above the pump is profiled, ensuring that the fewest number of stacked pump locations are used to complete the zonal flow and chemistry survey of the test well. This profiling process continues until all of the well screen is profiled. By the end of the profile, there may be only one tranche or potentially three or four tranches accompanied by 3 to 4 pump and packer locations from which a dynamic flow and chemistry profile was performed, hence the name Stacked Dynamic Profiling.

Thus, each SDP tooling placement starts at a location that is close to the pump and then moves further away to sequential locations that have been identified in the Injection and Sampling Plan, or ISP. The sequential distancing of the tooling from the pump continues until a location is reached where there is no detectable return of the tracer material. This location now becomes the new set depth for the next pump location and the series of velocity measurements and groundwater sample collection depths. The pump is turned off and the entire pump column and pump is raised to the next shallower depth location, removing sections of pump column to achieve this objective. As the pump column and pump are being raised the crew operating the Tracer Flowmeter and Depth Dependent Sampler is also raising the tooling, staying above the pump during the adjustment. Once the new location is reached, the surface configuration is reconnected, the packer inflated, and the pump turned back on. At this point, as with each and every other depth location, steady-state conditions are reached before the new SDP can be performed.

The discharge water from the pump, at the surface, for all of the vertical tranches being profiled, is run mostly through a main discharge line, but can also be run through a smaller diameter, auxiliary discharge line, that is essentially a hose, that is connected to the main discharge line by means of a hose bib on one end and connected to a flowmeter on the other end. The main discharge line has a flowmeter mounted to it as well to ensure that the pumping rate during the dynamic test is stabilized. The purpose of the fluorometer (flowmeter) is to detect the return of the tracer material from each injection depth in the pilot hole and/or test well, as specified by the Injection and Sampling Plan, and for the injection start time and the return time of each injection of the tracer material to be recorded manually and by the fluorometer and/or by means of a computer connected to the fluorometer by hardwire connection or wireless connection.

By knowing the travel time of the tracer material back to the tracer detector from each release point, knowing the depth of each release point, and knowing the cross-sectional surface area of the test well at each release point, the Continuity Equation can be applied to determine the volume and percentage of cumulative flow from each pair of consecutive release points. Subsequently, iterative algebraic subtraction between sequential pairs of cumulative flow values yield zonal contributions of fluid volume entering the test well over a given period of time (e.g., in gallons per minutes (GPM)). Once the flow values are derived from the use and application of the tracer injection system, the cumulative flow data is integrated within the mass balance equation such that the associated cumulative chemistry at each depth is flow weighted through an iterative calculation. In this way, the zonal chemistry associated with each flow contribution zone is derived.

At each injection depth, the tracer injection is typically performed multiple times to confirm reproducibility of the return time to the fluorometer. When the tracer injection button on the timer control unit is depressed, in certain embodiments, approximately 50 to 100 ml of tracer material is released into the test well via the injection nozzle outfitted with multiple-sideways injection ports. As the injection pressure spreads the tracer material sideways, it fills the cross-sectional plane (area) of the test well, circumferentially filling the free annulus around the pump column. The time of each release is recorded manually on a standardized log-form and electronically by a laptop computer. Following each injection, the tracer material is substantially instantaneously pulled downward towards the pump intake. The pump then pushes the tracer material to the surface, diluted within the returning groundwater and making a 90-degree turn into the discharge line. Since the tracer material is not typically visible to the naked-eye, an up-hole fluorometer can be utilized to electronically record its return. Upon the arrival of the tracer material to the surface, a small portion of the tracer material travels through a sample tap and garden hose to the fluorometer where the built-in light source excites the tracer material at a wavelength of approximately 560 nanometers. The optical detector records the presence of the tracer material and the time of return. The balance of the tracer material is discharged through the surface pipeline or hose into the waste stream. Zonal inflow values are then calculated from sequential pairs of tracer material return velocities using the Continuity Equation.

If the measurement is reproducible, the injection assembly of the tracer injection system is then moved to the next depth and the process is repeated. This process continues until all of the depths of interest for the flow survey are completed. The tracer injection tube itself of the tracer injection system moves through a mechanical or optical counter at the surface such that each injection depth can be tracked and recorded.

To derive zonal flow values, in-well flow velocities are calculated as the change in feet between each sequential pair of injection points (distance) divided by the change in tracer material return times to the surface-based tracer detector. The velocity value (d/t) for each interval is then multiplied by the cross-sectional area (of the donut) ($V*A=V*\pi r^2$) to calculate cumulative flow at each depth ($Q_n$). Zonal flow between each injection depth is then calculated as the algebraic difference between sequential cumulative flow values ($Q_T=Q_n-Q_{n+1}$). The calculation is performed iteratively throughout the test well to estimate the zonal flow contributions in GPM and in percent of the total contribution for each interval.

In some embodiments, a variety of downhole sensors can also be integrated into the tracer injection system, the groundwater sampling system or conjoined tracer injection system and groundwater sampling system, including conductivity, pH, dissolved oxygen, oxidation reduction potential, temperature, pressure, turbidity and chemical sensors of all types. These measurements are then collocated downhole with the flow and groundwater chemistry results as derived from the various groundwater samples. In other embodiments, such sensors can also be used uphole during the groundwater sampling survey, another approach for real time measurement of water parameters and chemistry when performing stacked dynamic profiling.

In each of the above examples of long-screened test wells, a Tracer Flowmeter and Depth Dependent Sampler is used to maximize the number of flow measurements and sample-chemistry collection depths in the shortest time possible. Such methodology provides a faster, more efficient way to perform a downhole survey to provide ample-enough flow and sample density to best reduce the risk of ending up with a completed well with one or more water quality issues. The stacking of pump locations, sideways injection and the miniaturized technologies improvements to the Tracer Flowmeter and Depth Dependent Sampler are utilized for time efficiency and accuracy to achieve reliable results in a shorter amount of time. In one representative example, the equivalent of 30 conventional zone tests were performed in six (6) days using the Tracer Flowmeter and Depth Dependent Sampler compared to the thirty (30) to forty-five (45) days that would be normally required using traditional methods. In 2021 US dollars, conventional zones test cost between \$20,000 to \$40,000 per test. Using an average dollar value of \$30,000 per conventional zone test multiplies to \$900,000 in drilling company costs if all 30 zone tests were performed by conventional methods. Adding consulting fees for planning, field supervision and reporting approximately can increase this cost by an additional \$300,000. The total cost associated with this example if using the conventional approach is more than \$1.1 MM US dollars per pilot hole. Using SDP, the total cost for performing 30 zone tests, including the construction of each test well and the consulting fees for planning, field supervision and hydrogeologic reporting ranges from approximately \$250,000 to \$380,000 US dollars per pilot hole. The cost for drilling the pilot hole is not included in this comparison since both the conventional and SDP approach require the same pilot hole diameter and depth.

Calculations for Flow Contribution—Continuity Equation:

Calculations are based upon the specific well information as well as field survey results $Q_n$ (depth dependent cumulative flow value). Up to three measurements may be collected at each discrete depth to determine an average cumulative flow.

$Q_n$ (GPM): depth-dependent cumulative flow value, $\Delta Q_{n,n+1}$ (GPM): zonal flow contribution between depths n and n+1, $V_n$ (Ft./min): depth-dependent velocity value, A (Ft.$^2$): well cross-sectional area, C: constant conversion factor (ft$^3$/min) to GPM, $r_{cas}$ (Ft.): well casing inner radius, $r_{col}$ (Ft.): outer radius of pump column, $d_{n+1}$ (Ft.): upstream injection depth, $d_n$ (Ft.): downstream injection depth, $t_{n+1}$ (min): return time of $d_{n+1}$, $t_n$ (min): return time of $d_n$.

a) Velocity (Ft./min):

$$1.\ v_n = \frac{(d_a - d_b)}{(t_b - t_a)}, \frac{(d_b - d_c)}{(t_c - t_b)}, \frac{(d_c - d_d)}{(t_d - t_c)}, \ldots, \frac{(d_n - d_{n+1})}{(t_{n+1} - t_n)}$$

for depth above pump intake, $d_n$, $d_{n+1}$, . . . , are calculated up and away from the intake.

$$2.\ v_n = \frac{(d_a - d_b)}{(t_b - t_a)}, \frac{(d_b - d_c)}{(t_c - t_b)}, \frac{(d_c - d_d)}{(t_d - t_c)}, \ldots, \frac{(d_n - d_{n+1})}{(t_{n+1} - t_n)}$$

for depths below pump intake, $d_n$, $d_{n+1}$, . . . , are calculated down and away from the intake.

b) Well Cross-Sectional Area (Ft.$^2$):

$$A=\pi r_{cas}^2 \text{ for zonal areas below the pump intake} \quad 3.$$

c) Cumulative Flow (GPM):

$$Q_n=(v_a*A*C),(v_b*A*C),(v_c*A*C), \ldots ,(v_n*A*C) \quad 4.$$

d) Zonal Flow Contribution (GPM):

$$\Delta Q_{n,n+1}=(Q_a-Q_b),(Q_b-Q_c),(Q_c-Q_d), \ldots ,(Q_n-Q_{n+1}) \quad 5.$$

Calculating Zonal Chemistry—The Mass Balance Equation:

The chemistry and water sampling portion of a dynamic profile occurs after the collection of the zonal flow data. Though fewer injections are applied during water sampling than flow injections, the depths used during sampling will match those used during the flow analysis.

During sampling, a proprietary gas driven pump, such as a Hydro-Booster, as developed by BESST, Inc., under a research and development contract for the USGS, can be used to collect water samples at various depths below ground surface. As previously stated, the pump is a gas-drive system and NOT an air-lift system. Therefore, there is no gas introduced into the sample stream when samples are collected. The pump has two modes of operation. The first is called the Fast Purge Mode (FPM). The FPM is performed at every depth and consists of filling the sample tubing with water from a given depth and completely releasing the volume of water using a single pump of pressurized gas. This is performed twice at each depth before a viable sample can be collected. Circulating water through the tubing at a given sample depth prior to sampling is known as purging. The purpose of the first purge is to remove the well water from the previous interval that remains inside the tubing. The second purge is performed, essentially, to wash the internal walls of the tubing with water from the newly intended sample depth to inhibit cross-contamination between depths. The second mode, known as the Ratchet Mode (RM), is performed in addition to the Fast Purge Mode during times of low-water volume, likely due to a decrease in sample tubing submergence. In some implementations, the RM may not be used due to a vast level of submergence. Water level measurements may be recorded at each sample depth to ensure a steady-state condition is maintained throughout the entire test. Prior to performing the dynamic profile of a given test well, an injection and sampling plan can be prepared. Sampling depths can be determined by available well information and lithology log, and they can be finalized after an assessment of the on-site flow contribution data. In one representative example, a total of eight samples were collected between the depths of 380 and 620 Ft. BGS, with two additional samples collected at the wellhead. The laboratory results for each analyte can be reported. The maximum contaminant levels (MCLs) can also be listed, for example, under California and Federal EPA MCL Standards. Certain water quality data analytes of concern can also be listed and examined in greater detail.

Calculating Flow Weighted Concentrations from Analytical Lab Results—Mass Balance Equation:

Assuming constant mixing inside the test well, the average zonal chemical contribution from cumulative contribution between any two vertically paired and consecutive water samples are derived. It is assumed in the calculations that analytes present within the test well mix as they move along the well column towards the pump intake. Much like the cumulative flow graph, the depth-dependent analytical lab results are assumed to be the cumulative chemical profile for the given interval. These cumulative lab results are then used to calculate zonal chemistry by finding the difference between the product of sequential paired depths of cumulative flow and cumulative chemistry, then dividing the calculated zonal chemistry by the zonal flow contribution from the equivalent depth interval (See the equations below).

After the mass balance results are calculated, results are finalized by comparing the theoretical wellhead average concentration with the actual wellhead average concentration. Percent error is also calculated during this step.

$Q_n$ (GPM)=Depth-dependent cumulative flow value $\Delta Q_{n,n+1}$ (GPM)=Zonal flow contribution between depths n and n+1

$C_n$=Depth-dependent lab concentration value $\Delta C_{n,n+1}$=Zonal chemical concentration between depths n and n+1

$$\Delta C_{n,n+1} = \frac{(Q_a * C_a) - (Q_b * C_b)}{(\Delta Q_{ab})}, \frac{(Q_b * C_b) - (Q_c * C_c)}{(\Delta Q_{bc})}, \frac{(Q_c * C_c) - (Q_a * C_a)}{(\Delta Q_{cd})}, \frac{(Q_n * C_n) - (Q_{n+1} * C_{n+1})}{(\Delta Q_{n,n+1})}$$

Calculations for Theoretical Average Analyte Chemistry $C_{tot}$=Composite sample collected at wellhead tap.

$C_{avg}$=Average analyte chemistry for all depth intervals to the $n^{th}$ degree.

$Q_{tot}$=Total cumulative discharge flowing out of the Well.

Theoretical Average Chemical Concentration $$C_{avg} = \frac{(\Delta Q_{ab} * \Delta C_{ab}) + (\Delta Q_{bc} * \Delta C_{bc}) + (\Delta Q_{cd} * \Delta C_{cd}) + \ldots + (\Delta Q_{n,n+1} * \Delta C_{n,n+1})}{Q_{tot}}$$

In summary, a point-by-point description of various non-exclusive, representative embodiments of systems and methods for the development of long-screened test wells that utilizes Stacked Dynamic Steady-State Flow and Chemistry Profiling can include one or more of the following steps, ideas, points, constraints or concepts:

1. A pilot hole, test hole or borehole is drilled through one or more aquifers for the purpose of building a test well and subsequently a groundwater supply well. In certain non-exclusive implementations, said aquifers can be located in sedimentary basins and in fractured bedrock, and can be of any depth. It is appreciated that the terms "pilot hole", "test hole" and "borehole" are used interchangeably herein.

2. The pilot hole can be drilled with any method, including mud and air rotary, reverse rotary, sonic, dual-tube percussion, dual-tube rotary, air rotary casing hammer, cable tool, auger, direct push, or any other suitable method.

3. The pilot hole can be of any diameter, the purpose of which is to build a long-screened test well in advance of the groundwater supply well for the purpose of profiling for zonal flow and chemistry. In some cases, within bedrock or other hard rock environments, where the rock materials are competent, and will not collapse into the pilot hole, the bedrock itself can comprise the test well-without having to construct a well to support the pilot hole to inhibit it from collapsing.

4. As the pilot hole is being drilled to total depth, the cuttings and core removed from the pilot hole are evaluated and catalogued to evaluate the sediment or rock types and their water bearing properties including grain size distribution and type, as well as rock types and fracture bearing qualities.

5. After the total depth of the pilot hole is reached, an optional step is to run downhole geophysical equipment such as resistivity, spontaneous potential, gamma ray, neutron, density, induction or any other type of probe or sensor to generate data that can be used to infer the sediment type, rock type and basic formational parameters such as permeability, porosity, saturation, salinity, conductivity and others. In bedrock pilot holes, even downhole video cameras can be used to identify the depth and characteristics of rock fractures and lineaments that intersect the pilot hole.

6. In cases where the pilot hole could collapse, the collective data is then used to design a test well made from any number of materials including any type of steel, PVC, carbon fiber, fiberglass and so on, the test well having more than 40 feet of well screen, and quite often having 50 to many hundreds of feet of well screen, either continuous or in sections, and being of any suitable diameter.

7. The test well is typically constructed with either a continuous gravel pack envelope around the outside of the test well and located between the test well and the formation wall of the pilot hole or installed in layers where it alternates with bentonite and/or cement seals aligned with fine-grained units such as clays and silts or even fine-grained rock types lacking fractures through which groundwater can flow. When the gravel pack is installed in sections of varying lengths with such seals in between the clay and/or cement seals, the purpose of such seals is to inhibit vertical migration of naturally occurring or anthropogenic contaminants through the gravel pack from one or more water bearing units to one or more receiving water bearing units, before, during or after testing.

8. The test well may also have a sanitary seal between the top (or shallowest depth) of the gravel pack and the ground surface, such seal being installed to inhibit migration of contaminants from the ground surface vertically downward along the outside of the test well. Such seal can be composed of any type of cement or bentonite mixture.

9. Following completion of the test well construction, the test well is developed, meaning that the drill flour, drilling fluid and mud cake, drilling fluid dispersants and other residual materials that have adhered to the pilot hole wall and/or have invaded into the surrounding formation are removed from the pilot hole using various methods including a swab, surge block, pump, and air lifting, as well as other methods, until the groundwater is satisfactorily clear for testing and sampling.

10. The drill cuttings and/or the geophysical logs are used to develop a Tracer Injection and Groundwater Sampling Plan in which the depths for tracer injection and groundwater sampling are identified in advance of the downhole testing.

11. The downhole testing performed is called dynamic, steady-state flow and chemistry testing. The testing is performed at a stabilized pumping rate and a stabilized draw down of groundwater inside the test well during the test such that there is minimal change in the pumping rate and pumping water level, typically equal to or less than a 5% change from the stabilized rate and depth used to perform the test.

12. In one implementation, to perform the desired testing, a pump and packer assembly is first placed near the bottom of the test well, the packer attached to the bottom of the pump and consisting of either a mechanical packer or an inflatable packer. If an inflatable packer is used, then a packer inflation line runs vertically alongside the outside of the pump and continues to the ground surface where a compressed gas system is located and used to inflate the packer.

13. The pump and packer assembly could also be placed near the top of the test well or in the middle of the test well to start, or in any other location other than the bottom. However, there are at least two reasons why the pump and packer assembly is typically placed near the bottom of the test well as the first of one or more locations to be used during the stacked dynamic profiling. The first reason is that although miniaturized tooling is being used between the pump column and the well screen and casing, the small diameter tooling may not be small enough to move past the pump and packer assembly without getting stuck inside the test well. However, the tooling is sufficiently small to move freely between the pump column and the casing, up and down, from one location to the next, above the pump and packer assembly, where tracer injections and water samples can be freely collected without spatial constraints during the test.

14. When starting at the bottom of the test well, the packer assembly is not necessarily inflated, since there is no well screen or minimal well screen below the packer assembly to be profiled and therefore there is little to no hydraulic influence or water chemistry influence to be measured below the pump and packer assembly. As such, when starting from the bottom, the tracer injection nozzle is typically placed in close proximity to the top of the pump and the first tracer volume released into the test well where it is then pulled down towards the pump's intake. The time of release of the tracer is recorded and the time of return detection to the ground-surface based fluorometer also recorded. Following the first injection, the tracer nozzle is moved to the next shallowest depth as shown on the Tracer Injection and Groundwater Sampling Plan and a small volume of tracer is released once again. The distances between the first and second, second and third, third and fourth injections, and so on can be any, with the purpose of each sequential pair of injections to determine the zonal flow entering the test well between each pair of injection points. This process continues until there is no return of the tracer following the injection. This indicates that the tracer was released at a depth location that was vertically above the pump's hydraulic capture distance within the test well.

15. If the tracer injection tubing is conjoined with the sample tubing, then a depth-dependent groundwater sample can be collected concurrently or immediately following the velocity measurement before moving to the next depth inside the test well.

16. On the other hand, the entire tracer velocity and flow survey can be completed first and then each or some of the locations revisited to collect the depth-dependent groundwater samples.

17. If desired, the depth-dependent groundwater samples can be collected first, particularly in situations where the time of the sampling effort is limited due to shipping cutoff times or lab receival times.

18. In some cases, the tracer injection survey is performed first within each pump-packer tranche since the velocity and flow data is used to refine the selection of the depth-dependent sample locations. In this scenario, once the first vertical tranche or section of the flow survey is completed inside the test well, the corresponding depth-dependent groundwater sampling survey can begin.

19. In some cases, the purpose of the dynamic survey is to only determine the distribution of the material's hydraulic properties, such as zonal flow as mentioned above. However, in other cases, the dynamic survey may also include using such data to determine estimates of zonal hydraulic conductivity and transmissivity using various algorithms such as the Moltz Equation or other similar equations. All of these hydraulic properties can also be collected with complimentary, collocated, depth-dependent groundwater samples such that the geochemical properties and contaminant characteristics of one or more water bearing units can be defined.

20. The tracer injection system consists of a flexible tube filled with a tracer material, and such tube is filled such that there are no air bubbles in the tubing that can interfere with the measurement of fluid velocities inside the test well. Since air bubbles can compress and expand, the presence of such bubbles creates delays in the release time that can vary from one injection depth to the next. When using the Continuity Equation to calculate return velocities from the release depth to the ground-surface based fluorometer, such air bubbles can create minor to large errors when calculating cumulative and zonal flows and when integrated with the mass balance equation, such errors can create carry over errors in the flow weighting calculation process used to estimate chemical and elemental mass concentrations in the surrounding aquifer materials.

21. As such, the tracer injection system must operate in such a way to inhibit the accumulation and entrainment of air bubbles inside the tracer injection system and tubing.

22. The tracer injection system is in part controlled by a timer control unit that is either a separate control unit that is electronically connected to the tracer injection system or such system controlled by a field computer such as a laptop.

23. Other components of the injection system include an injection motor and pump, a solenoid and an actuator, switching valves, a tracer circulation system, a compressed gas source and a tracer reservoir that is used to supply and reload the tracer tubing, airlessly following each tracer injection.

24. When the control unit is turned on, it activates the injection motor which in turn activates the injection pump. Concurrently, a compressed gas source is connected to an actuator which in turn is connected to a solenoid. The compressed gas source remains engaged at a fixed, regulated pressure the entire time, and such pressure is conveyed to open and close switching valves that allow the tracer to move under pressure through the tracer injection tubing or to circulate through the injection system and tracer reservoir when not injecting or idling.

25. The control unit (or computer) contains an injection button such that when depressed electrically, it activates a solenoid and in turn an actuator so that the tracer can be released downhole, migrating through the switching valve system, through the tracer tubing and end of tubing control valve and then into the test well. Such end of tubing control valve is used to inhibit the tracer from escaping or leaking into the test well when between measurements. When the back pressure of the valve is overcome, the tracer is released into the test well during the injection event when a velocity measurement is required.

26. In any of the depth-dependent groundwater sampling scenarios described above, a miniaturized sampler is used such that it easily fits and can transit within the annulus between the pump column, the well casing and well screen. The first groundwater sample can be taken at the first tracer injection location near the top of the pump, or even at the furthest location above the pump where there was a tracer return to the surface-based fluorometer. The depth-dependent groundwater samples are collocated with the tracer injection depths.

27. The miniaturized sampling pump assembly and tubing can be either conjoined to the tracer injection tubing as a unified system where both transit together simultaneously as a singular unit up and down the annulus of the well, or as two separate units. However, if there is enough annular space, it is preferred to run a conjoined system for two reasons. First, there is a phenomenon called counter error, caused by slippage of the tubing as it runs through the counter or by malfunction of the counter's metering system. If two separate lines are run, one for the tracer injection tubing and the other for the sampler tubing, there is a possibility that two separate counter errors occur and if this happens, it often results in vertical dislocation of the tracer injection and sampling depth. Ideally, they are supposed to be collocated such that the data pair can be used to perform a mass balance calculation with a sequentially located pair to derive a mass balance estimate of chemical concentration in the surrounding formation. If the tracer injection and sampling pair are vertically dislocated, then a mass balance error can occur, mismatching zonal flow and chemistry and potentially resulting in an incorrect estimate of contaminant mass for that zone. As such, the water supply well that is constructed on the basis of these estimates can be improperly constructed, with well screens being aligned with contaminated zones when the intention of the zonal flow and chemistry survey was to avoid build screens or perforations within these zones. For this reason, it is theoretically easier to reconcile one counter error as opposed to two counter errors if such error should occur. The other reason for using a unified system is that there is a time savings by only "tripping" one tubing assembly into the test well as opposed to two. Even if the time savings is only one-half day, it is important when the scientific team spends a great deal of time in the field and that part of their time is supposed to be for travel to and from the site. Moreover, project schedule is important from a budget standpoint and to keep the customer satisfied that the operation is being performed in a timely manner.

28. Following the completion of the first tranche, the pump and packer assembly is then moved to or near the location where there was no tracer return, determined on the first tranche, by lifting the pump column and removing sections of pump column until the target depth is reached. If using an inflatable packer, the packer is inflated at the second location to inhibit the pump from pulling water from below the assembly, a section of the hole already profiled. By employing this strategy, most if not all of the hydraulic force of the pump is forced upwards, or up hole, above the pump and packer assembly, such that a maximum vertical distance of formation above the pump is profiled, ensuring that the fewest number of stacked pump locations are used to complete the zonal flow and chemistry survey of the test well. This profiling process continues until all of the well screen is profiled. By the end of the profile, there may be only one tranche or potentially three or four tranches accompanied by 3 to 4 pump and packer locations from which a dynamic flow and chemistry profile was performed, hence the name Stacked Dynamic Profiling.

29. The discharge water from the pump, at the surface, for all of the vertical tranches being profiled, is run mostly through the main discharge line but also through a smaller diameter, auxiliary discharge line, that is essentially a hose, that is connected to the main discharge line by means of a hose bib on one end and connected to a flowmeter on the other end. The main discharge line has a flowmeter mounted to it as well to ensure that the pumping rate during the dynamic test is stabilized. The purpose of the fluorometer (flowmeter) is to detect the return of the tracer from each injection depth in the pilot hole, as specified by the Injection and Sampling Plan, and for the injection start time and the return time of each tracer injection to be recorded manually and by the fluorometer and/or by means of a computer connected to the fluorometer by hardwire connection or wireless connection.

30. To improve the accuracy of each tracer injection transit time between the tracer release and up hole tracer detection points, sideways injection from the tracer injection nozzle is used downhole and is a necessity for obtaining accurate tracer travel times. Ideally, flowmeter surveys are supposed to be centralized within the pilot hole or test well for the purpose of applying a correction coefficient that considers the vectoral shape of groundwater flow inside of a pipe. Within the pipe, there is axial flow, transitional flow and boundary flow regimes. Axial flow is the fastest and boundary flow the slowest and as such, when flow metering a pipe, the flow algorithm should consider these conditions to calculate a bulk average flow rate. Since a pump column is located in approximately the center of the test well, the axial flow cannot be measured. However, the annular flow between the pump column and casing and well screen is not entirely uniform and can vary circumferentially around the pipe due to off-centering of the pump column due to the deviation of the test well or the pump column. Therefore, it is important that flow in the annulus, on different sides of the pump column, at each injection point be considered in the flow calculation when using the continuity equation. Therefore, sideways injection of the tracer includes multiple release points and horizontal vectors that encompass the entire annulus between the pump column and the casing and well screen such that a bulk average flow rate can be calculated at each tracer injection depth.

31. Sideways injection is accompanied by two important features of the tracer injection system. First, the tracer injection system is of such design that air bubbles are inhibited and removed from injection manifold and tracer injection tubing. The presence of air bubbles can cause significant inaccuracies in tracer return times and flow calculations due to the compressibility of the air inside the system, such compressibility causing delays in the tracer release downhole and computational inaccuracies that create significant errors. As the size and number of air bubbles in the tracer injection system grow, so do the computational errors. Therefore, the injection system is equipped with an air purging apparatus to inhibit and/or prevent the existence of such bubbles. The second component that is important to tracer travel time computations is that the release of the tracer must be substantially instantaneous. To achieve instantaneous tracer release, there are two requirements. First, the tubing used for the testing should have minimal elasticity to minimize dilation of the tubing material during the injection, where such dilation causes a delay in the tracer release. And second, the tracer release is controlled by an electronically controlled actuator that can forcibly push the dye through the injection nozzle on command by means of an electronically controlled injection timer control unit.

32. Groundwater sampling is performed with a miniaturized pump, a long section of jacketed (coiled) tubing and a volume booster. The coiled tubing runs from the ground surface to the top of the volume booster, and the bottom of the volume booster connects to the top of the pump. The coiled tubing can be made from any material but is typically constructed from low pressure to high pressure Nylon, HDPE or Teflon polymers, depending on sampling depth and the type(s) of contaminants that are being searched for. The tubing can also be made from various types of metals, including stainless-steel for deep applications where sampling pressures required to lift groundwater to the surface exceed those of high-pressure polymer tubing. The coiled tubing is typically mounted to a mechanical, hand-powered or motorized hose reel that can deploy and retrieve the tubing. The tubing itself consists of two separate strands that run parallel to each other, preferably inside of the plastic jacket that keeps the two lines from separating during deployment and retrieval from the test well or pilot hole. Embedded within the jacket is a stainless-steel or ordinary steel safety cable that runs the entire length of the tubing coil, its purpose being to support the weight of the volume booster and pump located together at the bottom of the coiled tubing by means of crimped ferrules or safety quick links that join the coiled tubing to the volume booster.

33. As mentioned, there are two lines within the jacketed coiled tubing. One line delivers compressed gas from the surface and the other line transfers groundwater from the targeted sampling depth to the surface. The compressed gas is typically connected to an electrically powered timer control unit at the surface, but can be manually controlled as well, the purpose of the electronic or manual control being to cycle the gas pressure down the tubing, through the volume booster and to the pump in order to push groundwater to the surface and then to turn off the compressed gas source to allow the tubing to recover more water and refill (the off cycle) following the gas-on cycle. The compressed gas-on and gas-off cycles, combined with the timer control unit, the coiled tubing, the volume booster and a double valve pump make up the entire pumping system being used with stacked dynamic profiling. The benefit of such approach is the elimination of wires to control an electrically operated pump since wires are difficult and expensive to repair in the field during a profiling survey. Moreover, the double valve pump also has an advantage in not using a bladder or bladder pump. The limitation of a bladder pump is the bladder itself, which is typically made from a plastic poly material that expands and contract like a lung. When the bladder inflates by means of a gas-in line, the expanding bladder displaces water inside of a holding chamber up into the sample return line where after repeated cycles, the groundwater eventually exits the sample return line at the surface. Repeated inflation and deflation cycles apply wear and tear stresses on the bladder to the point where it tears and requires replacement. Moreover, at deeper depths, and as targeted sample depths become deeper and deeper, the bladder has increasing difficulty in overcoming the hydraulic head pressure from the lengthening fluid column inside the pilot hole or test well, to the point where expansion is laborious and slow moving, making the fluid velocity inside the sample return line slower and slower. As such more purge and sampling time is required. Lastly, use of an inflating and deflating bladder requires significantly more energy to operate compared to a double valve pump without a bladder, such that significantly more compressed gas is used to operate the system when compared to a double valve pump. Thus, the double valve pump requires no electrical wiring, requires no internal bladder, and operates with maximum efficiencies down hole, and even with increasing depths, using compressed gas.

34. The referenced double valve pump is preferably operated using compressed gas but can also be operated with a bladder or even electrically if desired. The pump being used is typically 1.25 inches or smaller in diameter and is typically four inches to ten inches in length. The slim design of the pump is preferred to facilitate ease of passage or transit between the pump column and the casing and well screen of the long-screened test well. The miniaturized pump that is used has varying lift capacities, dependent on the types of materials used to construct the miniaturized pump, but when using materials that are designed for very high compressed gas operational pressures, the pump can have a lift capacity up to 4,000 feet below ground surface. The pump consists of a two-valve system, one valve being called the foot valve and the other one being called the sample return line valve. The foot valve is located near the base of the pump body and the sample return line valve is located just below the top of the pump body, located inside of a water storage chamber that provides added volume to each pump cycle.

35. The miniaturized pump runs off compressed gas and such gas can consist of atmospheric (air) or a pure gas such as nitrogen, helium or argon, or any other inert gas. Release of the gas is manually operated or controlled with an electronic timer control unit with an on-off actuator system and pressure control regulator. Such timer control unit is programmable to set any on- and off-time duration required to cycle groundwater back to the surface. High pressure tubing is used in combination with said pump and timer control unit such that any required pump depth can be achieved. When compressed gas is released into the system, the gas enters the gas-in line and pushes down on the groundwater in that line. The load-pressure is translated hydraulically to the foot valve, forcing the foot valve to close, and the water from the gas-in line to perform a U-turn inside the miniaturized pump, where such water is then forced upwards through the sample return line valve and into the sample return line. Multiple repetitions of this cycle force the groundwater to the surface where it discharges into a container, either to hold purge water or for groundwater samples. When enough groundwater sample has been collected, the miniaturized pump is moved to the next sampling depth. The cycle is repeated, whereby the system is first purged two to three times to remove older water from the previous sampling event as well as to refresh the system with groundwater from the new depth.

36. In cases where there is insufficient submergence below the pumping water level for the groundwater sampling system to operate efficiently, a volume booster can be employed with the groundwater sampler. The volume booster, as its name implies, increases the volume per foot of tubing to increase the purge volume and sample volume on a single pump stroke. For example, if the sampling requirement is to collect 2-liters of groundwater from each depth, and the miniaturized pump is placed only 30-feet below the pumping water level, and the gas-in and sample return line only stores 180 milliliters, then up to ten or more pumping cycles would be required to achieve that volume. More than ten cycles would likely be required since a portion of the groundwater sticks to the inside of the tubing as it returns to the ground surface, whereby the actual discharge volume per pump stroke could be considerably less than the theoretical volume stored inside the tubing. This problem becomes exacerbated on deep pilot holes and test wells, where excess tubing is coiled onto a hose reel, as the sampler ascends up the well, moving to a shallower location each time. The coil friction inside the tubing is greater than the straight friction when the line is deployed inside the well, causing more water to stick inside the coil than inside the straight length of tubing. This reduces the purge and sample volume even further.

37. The volume booster is either of coaxial or parallel design, but preferably coaxial since its features are slimmer and less prone to getting stuck or smashed against pipe collars on the pump column when a parallel, side-by-side configuration is used. But either design can be of any length, and most commonly 10 to 40 feet long. The coaxial design consists of a tube inside of a tube. The outer tube has a relatively large inside diameter (i.e., ½ inch or ¾ inch) considering its miniaturized scale and the smaller tubing passing through the larger tube has an outside diameter of ¼ inch or 3/16 inch and an inside diameter of 3/16 inch to ⅛ inch. The annulus between the inner and outer tubing is where the extra volume of groundwater is stored. Each end of the volume booster is outfitted with a rigid fixture with two portals, one portal being connected to the gas-in line and the other portal being connected to the sample return line. The fixtures can be made from plastic or metal and both end fixtures have two tube connection ports, one for compressed gas and the other for sample return.

38. Compressed gas pressure, released from the surface, travels down the gas-in line of a jacketed tubing bundle until it reaches the complimentary gas-in port of the volume booster. There are two lines in the jacketed tubing bundle, one for compressed gas transfer and the other tube for return of purge and sample water from the targeted sampling depth. Compressed gas from the gas-in line pushes down on the stored water inside the volume booster forcing this water through the miniaturized pump. As the groundwater transits through the miniaturized pump, the hydraulic load from the compressed gas forces the poppet inside the foot valve to close, and as such, performs a U-turn inside the pump where it travels upwards through the sample return line valve and through the inner tube of the volume booster. Upon exiting the top of the volume booster, the groundwater then travels through the sample return line back to the ground surface where the purge water and samples are collected in containers. The use of the volume booster is an important feature to an efficient groundwater sampling program when profiling long-screened test wells, reducing the sampling time by up to one-half the time required if the volume booster is not used.

39. A variety of downhole sensors can be integrated into the tracer injection, miniaturized pump or conjoined tracer injection and miniaturized pump system, including conductivity, pH, dissolved oxygen, oxidation reduction potential, temperature, pressure, turbidity and chemical sensors of all types. These measurements are then collocated downhole with the flow and groundwater chemistry results as derived from the various groundwater samples.

40. Such sensors can also be used up hole during the groundwater sampling survey, another approach for real time measurement of water parameters and chemistry when performing stacked dynamic profiling.

41. Calculating Cumulative and Zonal Flow from Fluid Velocity Measurements:

$Q_n$ (GPM): depth-dependent cumulative flow value, $\Delta Q_{n,n+1}$ (GPM): zonal flow contribution between depths n and n+1, $V_n$ (Ft./min): depth-dependent velocity value, A (Ft.$^2$): well cross-sectional area, C: constant conversion factor (ft$^3$/min) to GPM, $r_{cas}$ (Ft.): well casing inner radius, $r_{col}$ (Ft.): outer radius of pump column, $d_{n+1}$ (Ft.): upstream injection depth, $d_n$ (Ft.): downstream injection depth, $t_{n+1}$ (min): return time of $d_{n+1}$, $t_n$ (min): return time of $d_n$.

a) Velocity (Ft./min):

$$1.\ v_n = \frac{(d_a - d_b)}{(t_b - t_a)}, \frac{(d_b - d_c)}{(t_c - t_b)}, \frac{(d_c - d_d)}{(t_d - t_c)}, \ldots, \frac{(d_n - d_{n+1})}{(t_{n+1} - t_n)}$$

for depth above pump intake, $d_n$, $d_{n+1}$, . . . , are calculated up and away from the intake.

$$2.\ v_n = \frac{(d_a - d_b)}{(t_b - t_a)}, \frac{(d_b - d_c)}{(t_c - t_b)}, \frac{(d_c - d_d)}{(t_d - t_c)}, \ldots, \frac{(d_n - d_{n+1})}{(t_{n+1} - t_n)}$$

for depths below pump intake, $d_n$, $d_{n+1}$, . . . , are calculated down and away from the intake.

b) Well Cross-Sectional Area (Ft.$^2$):

$$A=\pi r_{cas}^2 \text{ for zonal areas below the pump intake} \quad 3.$$

$$A=\pi r_{casing}^2-\pi r_{pump\ column}^2 \text{ for zonal areas above the pump intake} \quad 4.$$

c) Cumulative Flow (GPM):

$$Q_n=(v_a*A*C),(v_b*A*C),(v_c*A*C), \ldots ,(v_n*A*C) \quad 5.$$

d) Zonal Flow Contribution (GPM):

$$\Delta Q_{n,n+1}=(Q_a-Q_b),(Q_b-Q_c),(Q_c-Q_d), \ldots ,(Q_n-Q_{n+1}) \quad 6.$$

42. Assuming constant mixing inside the well, the average zonal chemical contribution from cumulative contribution between any two vertically paired and consecutive water samples were derived. It is assumed in the calculations that analytes present within the test well mix as they move along the well column towards the pump intake. Much like the cumulative flow graph, the depth-dependent analytical lab results are assumed to be the cumulative chemical profile for the given interval. These cumulative lab results were then used to calculate zonal chemistry by finding the difference between the product of sequential paired depths of cumulative flow and cumulative chemistry, then divide the calculated zonal chemistry by the zonal flow contribution from the equivalent depth interval (See the equations below).

After the mass balance results are calculated, the results are finalized by comparing the theoretical wellhead average concentration with the actual wellhead average concentration. Percent error is also calculated during this step.

$Q_n$ (GPM)=Depth-dependent cumulative flow value $\Delta Q_{n,n+1}$ (GPM)=Zonal flow contribution between depths n and n+1

$C_n$=Depth-dependent lab concentration value $\Delta C_{n,n+1}$=Zonal chemical concentration between depths n and n+1

$$\Delta C_{n,n+1} = \frac{(Q_a * C_a) - (Q_b * C_b)}{(\Delta Q_{ab})}, \frac{(Q_b * C_b) - (Q_c * C_c)}{(\Delta Q_{bc})}, \frac{(Q_c * C_c) - (Q_a * C_a)}{(\Delta Q_{cd})}, \frac{(Q_n * C_n) - (Q_{n+1} * C_{n+1})}{(\Delta Q_{n,n+1})}$$

Calculations for Theoretical Average Analyte Chemistry $C_{tot}$=Composite sample collected at wellhead tap.

$C_{avg}$=Average analyte chemistry for all depth intervals to the n$^{th}$ degree.

$Q_{tot}$=Total cumulative discharge flowing out of the Well.

Theoretical Average Chemical Concentration $$C_{avg} = \frac{(\Delta Q_{ab} * \Delta C_{ab}) + (\Delta Q_{bc} * \Delta C_{bc}) + (\Delta Q_{cd} * \Delta C_{cd}) + \ldots + (\Delta Q_{n,n+1} * \Delta C_{n,n+1})}{Q_{tot}}$$

It is understood that although a number of different embodiments of the Stacked Dynamic Flow and Chemistry Profiling System and Method have been illustrated and described herein, one or more features of any one embodiment can be combined with one or more features of one or more of the other embodiments, provided that such combination satisfies the intent of the present invention.

While a number of exemplary aspects and embodiments of the Stacked Dynamic Flow and Chemistry Profiling System and Method have been shown and disclosed herein above, those of skill in the art will recognize certain modifications, permutations, additions and sub-combinations thereof. It is therefore intended that the flowmeter profiling system shall be interpreted to include all such modifications, permutations, additions and sub-combinations as are within their true spirit and scope, and no limitations are intended to the details of construction or design herein shown.

What is claimed is:

1. A method for determining dynamic steady-state flow and chemistry of groundwater within a long-screened test well, the method comprising the steps of:

drilling a pilot hole through one or more aquifers;

installing a test well within the pilot hole, the test well including a well screen that is at least 40 feet in length;

positioning a pump within the test well, the pump being configured to move the groundwater within the test well;

positioning a packer assembly within the test well, the packer assembly being configured to selectively provide a seal between the test well and the pilot hole; and performing downhole testing at a plurality of different depths within the test well with miniaturized technologies that are equal to or less than 1.5 inches in diameter, the downhole testing being utilized to determine a dynamic steady-state flow and chemistry profile of the groundwater within the test well.

2. The method of claim 1 wherein the pump is an electric submersible pump.

3. The method of claim 1 wherein the pump and the packer assembly are conjoined together, with the packer assembly including an inflatable packer that is attached to the pump near a bottom of the pump.

4. The method of claim 1 wherein the pump is used at a first depth within the test well and then is moved from the first depth to a second depth within the test well that is different than the first depth to perform stacked dynamic steady-state flow and chemistry profiles.

5. The method of claim 1 wherein the step of drilling includes evaluating cuttings and core removed during drilling of the pilot hole for at least one of type of rock, type of sediment and water bearing properties.

6. The method of claim 5 wherein drill cuttings and electric logs are used to locate screened intervals of the well screen and to develop a tracer injection and sampling plan to be implemented with the miniaturized technologies.

7. A method for determining dynamic steady-state flow and chemistry of groundwater within a long-screened test well, the method comprising the steps of:

drilling a pilot hole through one or more aquifers;

installing a test well within the pilot hole, the test well including a well screen that is at least 40 feet in length;

positioning a pump within the test well, the pump being configured to move the groundwater within the test well;

positioning a packer assembly within the test well, the packer assembly being configured to selectively provide a seal between the test well and the pilot hole; and performing downhole testing at a plurality of different depths within the test well with miniaturized technologies that are equal to or less than 1.5 inches in diameter, the downhole testing being utilized to determine a dynamic steady-state flow and chemistry profile of the groundwater within the test well;

wherein the step of drilling includes drilling the pilot hole using one of (i) a direct mud rotary drilling method that is configured to drill the pilot hole having a diameter of between approximately 12 inches and 14 inches; and (ii) a reverse mud rotary drilling method that is configured to drill the pilot hole having a diameter of at least approximately 14 inches.

8. The method of claim 1 wherein the step of performing includes the miniaturized technologies including a tracer injection system that is configured to determine downhole velocity and flow measurements of the groundwater within the test well.

9. The method of claim 8 wherein the tracer injection system includes a flexible tube that is filled with a tracer material, the flexible tube being configured to inject the tracer material sideways into the groundwater within the test well to determine the downhole velocity and flow measurements; wherein air bubbles are inhibited from entering the flexible tube; and wherein timing of injection of the tracer material from the flexible tube into the groundwater within the test well is controlled at least in part by a timer control unit.

10. The method of claim 8 wherein the step of performing includes the miniaturized technologies further including a groundwater sampling system that is configured to selectively remove groundwater samples from the test well.

11. The method of claim 10 wherein the tracer injection system and the groundwater sampling system are joined into a single, conjoined, downhole unit so that the tracer injection system and the groundwater sampling system move together to different depths within the test well.

12. The method of claim 1 wherein the step of performing includes the miniaturized technologies including a groundwater sampling system that is configured to selectively remove groundwater samples from the test well.

13. The method of claim 12 wherein the groundwater sampling system includes a miniaturized pump, a section of jacketed tubing, and a volume booster; and wherein the section of jacketed tubing includes a first tube that is configured to deliver compressed gas from a surface level to a targeted sampling depth, and a second tube that is configured to transfer groundwater from the targeted sampling depth to the surface level.

14. A flow and chemistry profiling system for determining dynamic steady-state flow and chemistry of groundwater within a long-screened test well, the flow and chemistry profiling system comprising:

a pilot hole that is drilled through one or more aquifers;

a test well that is installed within the pilot hole, the test well including a well screen that is at least 40 feet in length;

a pump that is positioned within the test well, the pump being configured to move the groundwater within the test well;

a packer assembly that is positioned within the test well, the packer assembly being configured to selectively provide a seal between the test well and the pilot hole; and miniaturized technologies that are utilized for performing downhole testing at a plurality of different depths within the test well, the miniaturized technologies being equal to or less than 1.5 inches in diameter, the downhole testing being utilized to determine a dynamic steady-state flow and chemistry profile of the groundwater within the test well.

15. The flow and chemistry profiling system of claim 14 wherein the pump is an electric submersible pump.

16. The flow and chemistry profiling system of claim 14 wherein the pump and the packer assembly are conjoined together, with the packer assembly including an inflatable packer that is attached to the pump near a bottom of the pump.

17. The flow and chemistry profiling system of claim 14 wherein the pump is used at a first depth within the test well and then is moved from the first depth to a second depth within the test well that is different than the first depth to perform stacked dynamic steady-state flow and chemistry profiles.

18. The flow and chemistry profiling system of claim 14 wherein cuttings and core removed during drilling of the pilot hole are evaluated for at least one of type of rock, type of sediment and water bearing properties.

19. A flow and chemistry profiling system for determining dynamic steady-state flow and chemistry of groundwater within a long-screened test well, the flow and chemistry profiling system comprising:

a pilot hole that is drilled through one or more aquifers;

a test well that is installed within the pilot hole, the test well including a well screen that is at least 40 feet in length;

a pump that is positioned within the test well, the pump being configured to move the groundwater within the test well;

a packer assembly that is positioned within the test well, the packer assembly being configured to selectively provide a seal between the test well and the pilot hole; and miniaturized technologies that are utilized for performing downhole testing at a plurality of different depths within the test well, the miniaturized technologies being equal to or less than 1.5 inches in diameter, the downhole testing being utilized to determine a dynamic steady-state flow and chemistry profile of the groundwater within the test well;

wherein cuttings and core removed during drilling of the pilot hole are evaluated for at least one of type of rock, type of sediment and water bearing properties;

wherein drill cuttings and electric logs are used to locate screened intervals of the well screen and to develop a tracer injection and sampling plan to be implemented with the miniaturized technologies.

20. The flow and chemistry profiling system of claim 14 wherein the pilot hole is drilled using one of (i) a direct mud rotary drilling method that is configured to drill the pilot hole having a diameter of between approximately 12 inches and 14 inches; and (ii) a reverse mud rotary drilling method that is configured to drill the pilot hole having a diameter of at least approximately 17.5 inches.

21. The flow and chemistry profiling system of claim 14 wherein the miniaturized technologies includes a tracer injection system that is configured to determine downhole velocity and flow measurements of the groundwater within the test well.

22. The flow and chemistry profiling system of claim 21 wherein the tracer injection system includes a flexible tube that is filled with a tracer material, the flexible tube being configured to inject the tracer material sideways into the groundwater within the test well to determine the downhole velocity and flow measurements; wherein air bubbles are inhibited from entering the flexible tube; and wherein timing of injection of the tracer material from the flexible tube into the groundwater within the test well is controlled at least in part by a timer control unit.

23. The flow and chemistry profiling system of claim 21 wherein the miniaturized technologies further includes a groundwater sampling system that is configured to selectively remove groundwater samples from the test well.

24. The flow and chemistry profiling system of claim 23 wherein the tracer injection system and the groundwater sampling system are joined into a single, conjoined, downhole unit so that the tracer injection system and the groundwater sampling system move together to different depths within the test well.

25. The flow and chemistry profiling system of claim 14 wherein the miniaturized technologies includes a groundwater sampling system that is configured to selectively remove groundwater samples from the test well.

26. The flow and chemistry profiling system of claim 25 wherein the groundwater sampling system includes a miniaturized pump, a section of jacketed tubing, and a volume booster; and wherein the section of jacketed tubing includes a first tube that is configured to deliver compressed gas from a surface level to a targeted sampling depth, and a second tube that is configured to transfer groundwater from the targeted sampling depth to the surface level.

* * * * *